US008130246B2

(12) United States Patent
Ishihara

(10) Patent No.: US 8,130,246 B2
(45) Date of Patent: Mar. 6, 2012

(54) IMAGE DISPLAY APPARATUS, IMAGE DISPLAY MONITOR AND TELEVISION RECEIVER

(75) Inventor: Tomoyuki Ishihara, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 1243 days.

(21) Appl. No.: 11/884,120

(22) PCT Filed: Mar. 10, 2006

(86) PCT No.: PCT/JP2006/304769

§ 371 (c)(1),
(2), (4) Date: Aug. 10, 2007

(87) PCT Pub. No.: WO2006/098244

PCT Pub. Date: Sep. 21, 2006

(65) Prior Publication Data

US 2008/0129672 A1 Jun. 5, 2008

(30) Foreign Application Priority Data

Mar. 14, 2005 (JP) ..... 2005-071953

(51) Int. Cl.
*G09G 3/36* (2006.01)

(52) U.S. Cl. ..... 345/690; 345/89

(58) Field of Classification Search ..... 345/87–102, 345/690, 211, 691, 212
See application file for complete search history.

(56) References Cited

U.S. PATENT DOCUMENTS

| | | | | |
|---|---|---|---|---|
| 5,347,294 | A | 9/1994 | Usui et al. | |
| 6,825,824 | B2 * | 11/2004 | Lee | 345/89 |
| 6,952,192 | B2 * | 10/2005 | Ohmuro et al. | 345/87 |
| 7,002,540 | B2 * | 2/2006 | Aoki | 345/89 |
| 7,057,597 | B2 * | 6/2006 | Ikeda | 345/95 |
| 7,239,298 | B2 * | 7/2007 | Adachi et al. | 345/89 |
| 7,804,846 | B2 * | 9/2010 | Sarhan et al. | 370/464 |
| 2002/0044115 | A1 | 4/2002 | Jinda et al. | |
| 2002/0097252 | A1 | 7/2002 | Hirohata | |
| 2003/0048247 | A1 | 3/2003 | Ham | |
| 2003/0058264 | A1 | 3/2003 | Takako et al. | |
| 2003/0156092 | A1 | 8/2003 | Suzuki et al. | |
| 2004/0233157 | A1 | 11/2004 | Sekiya et al. | |
| 2005/0030302 | A1 | 2/2005 | Nishi et al. | |

FOREIGN PATENT DOCUMENTS

| | | |
|---|---|---|
| JP | 2650479 | 5/1997 |
| JP | 2001-296841 | 10/2001 |
| JP | 2002-116743 | 4/2002 |
| JP | 2002-318569 | 10/2002 |
| JP | 2003-345285 | 12/2003 |
| JP | 2004-287139 | 10/2004 |

* cited by examiner

*Primary Examiner* — Duc Dinh
(74) *Attorney, Agent, or Firm* — Harness, Dickey & Pierce, P.L.C.

(57) ABSTRACT

A point at which the luminance varies between successive frames is detected with respect to an input image signal whose one-frame period is represented by a given gradation level. In a frame in which the luminance has just varied (i.e., in a post-change frame), the gradation level is corrected so that the lack of response of an image display panel is remedied (overshoot driving). In at least one embodiment, a sub-frame signal is generated in accordance with the signal whose gradation level has been corrected, so that an output gradation level to be outputted to the image display panel is obtained.

32 Claims, 17 Drawing Sheets

IMAGE DISPLAY APPARATUS, IMAGE DISPLAY MONITOR AND TELEVISION RECEIVER

TECHNICAL FIELD

The present invention relates to an image display apparatus, such as a liquid crystal display apparatus, which has a hold display element whose response speed is relatively low.

BACKGROUND ART

In recent years, liquid crystal display apparatuses have been used as various display apparatuses such as television monitors and personal-computer monitors.

The liquid crystal display apparatuses share such a common problem of an out-of-focus moving image that a boundary between parts of different display luminance is blurred in displaying a moving image. The problem of an out-of-focus moving image is attributed to a hold display carried out such that the previously written display content is maintained in a pixel being in its non-select period, and is peculiar to hold display apparatuses such as liquid crystal display apparatuses and organic EL display apparatuses. That is, display apparatuses, such as CRT (cathode-ray tube) display apparatuses and plasma display apparatuses, which carries out an impulse display (i.e., a display that is carried out only in a light-emitting period) are free from the problem of an out-of-focus moving image.

Examples of a method for preventing an out-of-focus moving image in a liquid crystal display apparatus include a technique (pseudo-impulse driving) of carrying out a display pseudo-similar to an impulse display by time-dividing one vertical period (one frame) into a plurality of sub-frames and by writing a signal in one pixel more than once. That is, an out-of-focus moving image is effectively prevented in a hold display apparatus by carrying out a low-luminance display (i.e., a display similar to a black display) at least in one of the sub-frames by means of time-division driving.

The reason why an effect of preventing an out-of-focus moving image is obtained by means of pseudo-impulse driving will be briefly described below with reference to FIGS. 12(*a*) and 12(*b*).

FIG. 12(*a*) is a diagram showing how a boundary between two regions of different display luminance moves at the time of hold driving. The vertical axis represents time; the horizontal axis represents location. Similarly, FIG. 12(*b*) is a diagram showing how a boundary between two regions of different display luminance moves at the time of pseudo-impulse driving. In FIG. 12(*b*), which shows pseudo-impulse driving, one frame is equally divided into two sub-frames at a ratio of 1:1.

In cases where the boundary moves in this way, the line of sight of the observer moves in accordance with the movement of the boundary. That is, in FIG. 12(*a*), the line of sight of the observer is represented by arrows 101 and 102. Moreover, a luminance distribution as seen by the observer in the vicinity of the boundary is obtained by time-integrating the display luminance in accordance with the movement of the line of sight. For this reason, in FIG. 12(*a*), a region located on the left side of the arrow 101 is perceived to be as luminous as a region located on the left side of the boundary, and a region located on the right side of the arrow 102 is perceived to be as luminous as a region located on the right side of the boundary. Meanwhile, a region located between the arrows 101 and 102 is perceived as if the luminance gradually increased. It is this portion that is recognized as image blur.

Similarly, in the case of pseudo-impulse driving shown in FIG. 12(*b*), according to the luminance distribution as seen by the observer in the vicinity of the boundary, image blur occurs in a region located between arrows 103 and 104. However, the slope is steeper than in the case of hold driving shown in FIG. 12(*a*). This shows that the image blur is reduced.

Further, in addition to the problem of an out-of-focus moving image, the liquid crystal display apparatuses shares such a common problem that a liquid crystal element has low response speed. Because of such a problem of response speed, in a liquid crystal display apparatus, a luminance response level attained after a change in input gradation may not reach a level attained when the input gradation is at rest.

A generally-known technique for remedying such low response speed is overshoot driving. The overshoot driving is such a driving method that a liquid crystal element is forcibly driven at a high speed by applying, to the liquid crystal element, a voltage slightly higher or lower than an applied voltage that gives a desired gradation level is applied to a liquid crystal element in accordance with an increase or a decrease in input gradation so that the liquid crystal element is forcibly driven at a high speed. Such overshoot driving is disclosed in Patent Documents 1 and 2.

Patent Document 1: Japanese Unexamined Patent Application Publication No. 174186/1991 (Tokukaihei 3-174186; published on Jul. 29, 1991)

Patent Document 2: Japanese Patent No. 2776090 (Tokkyo 2776090; published on Mar. 26, 1993)

DISCLOSURE OF INVENTION

In cases where pseudo-impulse driving is carried out for the purpose of reducing the image blur in a liquid crystal display apparatus having the aforementioned problem of response speed, there occurs such a new problem that a pseudo contour occurs.

The occurrence of a pseudo-contour will be described below with reference to FIGS. 13 through 15. For example, see a case where, as shown in FIG. 13, a boundary between regions (i) and (ii) moves. In the region (i), a display is carried out with a time-division gradation of First-half gradation=Second-half gradation=0%. In the region (ii), a display is carried out with a time-division gradation of First-half gradation=0% and Second-half gradation=100%.

On this occasion, the actual luminance of the location of a pixel in which the boundary moves does not reach, due to low response speed, a luminance corresponding to a gradation signal. This results in such luminance response as shown in FIG. 14. For simplicity of explanation, the luminance response curves are ignored, and the luminances respectively attained at the ends of all the sub-frames are correlated. Then, as with FIGS. 12(*a*) and 12(*b*), the display luminance is time-integrated in accordance with the movement of the line of sight. As a result, a luminance distribution is obtained as seen by the observer in the vicinity of the boundary. The luminance distribution is shown in FIG. 15. That is, in the luminance distribution as seen by the observer, a region having a relatively low rate of change in luminance appears in part of a region between two gradation regions (i.e., a region where image blur has occurred); therefore, two contours are observed in the regions, each having a relatively high rate of change in luminance, which are respectively located at both ends of the region having a relatively low rate of change in luminance. That is, a pseudo contour is observed in addition to the original contour.

For comparison, FIG. 16 shows a luminance distribution obtained in cases where hold driving is carried out. In this case, a region having no (or a small) change in luminance does not appear in the region where image blur has occurred. Therefore, no pseudo contour is observed.

FIG. 13 is simplified for the purpose of explaining the way a pseudo contour occurs. However, in practice, as shown in FIG. 17, an inflection point often appears in a region where image blur has occurred. Even in such a luminance distribution, a region having a small change in luminance appears around the inflection point, and big changes in luminance occur at both ends of the region. Therefore, two contours (original contour and pseudo contour) are observed.

As described above, the problem of a pseudo contour is caused due to a combination of (i) slow response speed of a liquid crystal element and (ii) pseudo-impulse driving. However, the overshoot driving disclosed in Patent Document 1 is not compatible with time-division gradation driving. Further, the overshoot driving disclosed in Patent Document 2 shows a method of overshoot driving compatible with time-division gradation driving carried out as hold driving in order to carry out a multicolor display with a small number of gradation data bits, and therefore is not compatible with a pseudo-impulse driving method for reducing image blur.

The present invention has been made in view of the foregoing problems, and it is an object of the present invention to realize an image display apparatus capable of eliminating a pseudo contour that occurs due to a combination of (i) slow response speed of a display element such as a liquid crystal element and (ii) pseudo-impulse driving.

In order to solve the foregoing problems, an image display apparatus according to the present invention is an image display apparatus for displaying an image by time-dividing one frame period of an input image signal into a plurality of sub-frame periods, including: correcting means for, with respect a pixel in which a gradation level varies by not less than a predetermined value between successive frames, correcting the gradation level in such a direction that response speed of the pixel is increased; and allocating means for, in accordance with an image signal whose gradation level has been corrected by the correction section, allocating a luminance to each sub-frame so that a total of time-integral values of luminance of each sub-frame within one frame period reproduces a luminance of one frame period which luminance is based on the input image signal.

Further, the image display apparatus can be arranged such that the correcting means corrects the gradation level so that a luminance obtained at the end of each sub-frame of a frame in which the gradation level has just varied coincides with a luminance that is to be obtained at the end of each sub-frame when an uncorrected gradation level is at rest.

In cases where the gradation level varies between the frames compared with each other, the application of a voltage corresponding to the input gradation level in the post-change frame does not make it possible to attain a predetermined luminance response level (i.e., a luminance response level attained at rest where there is no (or little) difference in gradation level between the frames) within the frame period in an image display panel (e.g., a liquid crystal panel) whose display element (pixel) has low response speed. Especially, in cases where an image is displayed by time-dividing one frame period into a plurality of sub-frame periods, the display element must finish responding within each sub-frame period. As a result, the foregoing problems become more prominent.

According to the foregoing arrangement, overshoot driving for remedying the slow response speed of the pixel can be carried out in such an image display apparatus by correcting the input image signal with the correcting means and by correcting the output gradation level of the post-change frame.

Moreover, the allocating means allocates a display luminance to each sub-frame in accordance with the image signal whose gradation level has been corrected by the correcting means, so that the luminance response level at the end of the post-change frame can be matched to the luminance response level at rest.

In order to solve the foregoing problems, another image display apparatus according to the present invention is an image display apparatus for displaying an image by time-dividing one frame period of an input image signal into a plurality of sub-frame periods, including: sub-frame signal generating means for correcting a gradation level with respect to a pixel in which the gradation level varies between successive frames, and for generating a sub-frame signal by allocating a luminance to each sub-frame so that a total of time-integral values of luminance of each sub-frame within one frame period reproduces a luminance of one frame period which luminance is based on the input image signal.

According to the foregoing arrangement, overshoot driving for remedying the slow response speed of the pixel can be carried out by correcting the input image signal with the sub-frame signal generating means and by correcting the output gradation level of the post-change frame. Each sub-frame signal is generated by allocating a display luminance to each sub-frame, so that the luminance response level at the end of the post-change frame can be matched to the luminance response level at rest.

Furthermore, it is possible to randomly set in which sub-frame of the post-change frame overshoot driving is to be carried out. Further, a gradation level correction for overshoot driving can be made in the pre-change frame as well as the post-change frame. That is, overshoot driving including selecting a sub-frame in which a gradation level correction is to be made can be carried out. As a result, a more preferable display can be obtained.

BRIEF DESCRIPTION OF DRAWINGS

FIG. 12(*b*) is a diagram showing how a boundary between two regions of different luminance moves at the time of pseudo-impulse driving.

BEST MODE FOR CARRYING OUT THE INVENTION

An embodiment of the present invention will be described below with reference to the drawings. First, an arrangement of an image display apparatus according to Embodiment 1 will be schematically described below with reference to FIG. 2.

Figure 2:
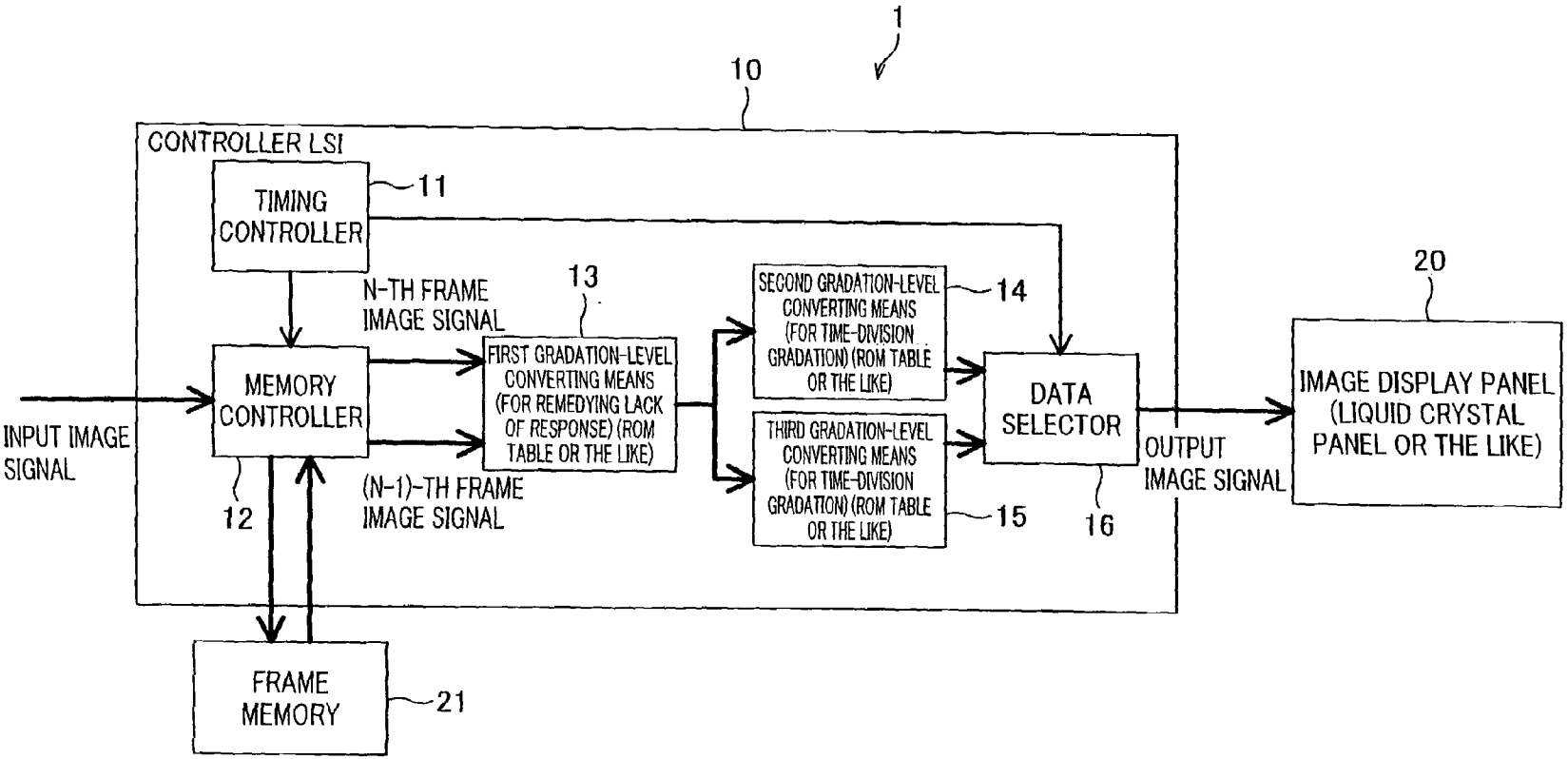
FIG. 2 is a block diagram schematically showing an arrangement of the image display apparatus according to Embodiment 1.

As shown in FIG. 2, the image display apparatus 1 includes a controller LSI 10, an image display panel 20, and a frame memory 21. That is, an input image signal inputted to the image display apparatus 1 (e.g., from an external apparatus, such as a personal computer, connected thereto) is processed in the controller LSI 10, and then is outputted as an output image signal to the image display panel 20. The image display panel 20 displays an image in accordance with the output image signal sent from the controller LSI 10.

The controller LSI 10 includes a timing controller 11, a memory controller 12, first gradation-level converting means 13 for remedying the lack of response, second gradation-level converting means 14 for a time-division gradation, third gradation-level converting means 15 for a time-division gradation, and a data selector 16.

The timing controller 11 generates a timing signal for controlling the memory controller 12 and the data selector 16. In accordance with the timing signal generated by the timing controller 11, the controller LSI 10 time-divides a 60 Hz input frame period into two sub-frames: a first sub-frame period and a second sub-frame period.

In accordance with the timing signal sent from the timing controller 11, the memory controller 12 carries out the following time-division operations (1) to (3):

(1) An input image signal having a predetermined frame frequency (e.g., 60 Hz) is written in the frame memory 21;

(2) An image signal of the N-th frame which image signal has been written in the frame memory 21 is read out twice at a frequency twice as high (e.g., 120 Hz) as the frame frequency at which the input image signal was written in, and then is transferred to the first gradation-level converting means 13; and (3) An image signal of the (N−1)-th frame which image signal has been written in the frame memory 21 is read out twice at a frequency twice as high (e.g., 120 Hz) as the frame frequency at which the input image signal was written in, and then is transferred to the first gradation-level converting means 13.

On the occasion when an image of the N-th frame is displayed, the first gradation-level converting means 13 outputs, in accordance with the gradation level of the inputted image signal of the N-th frame and the gradation level of the inputted image signal of the (N−1)-th frame, such a gradation level for each pixel that deterioration caused in quality of an moving image due to lack of response of the image display panel 20 is reduced. That is, the first gradation-level converting means 13 serves as means for carrying out overshoot driving in cases where the lack of response of the image display panel 20 is caused with normal driving.

Embodiment 1 uses a ROM table as the first gradation-level converting means 13. The ROM table serving as the first gradation-level converting means 13 receives an 8-bit signal obtained by adding together (i) the high 4 bits of the gradation level of the image signal of the N-th frame and (ii) the high 4 bits of the gradation level of the image signal of the (N−1)-th frame, and then outputs an 8-bit gradation level corresponding to the input data. That is, the first gradation-level converting means 13 is a ROM table of $2^{(4+4)}\times 8=2048$ bits.

Further, it is conceivable that there is only a little deterioration in quality of a moving image in cases where there is only a small difference in gradation level between the image signal of the N-th frame and the image signal of the (N−1)-th frame. For this reason, in cases where the difference in gradation level between the image signal of the N-th frame and the image signal of the (N−1)-th frame is not more than 15 gradations, the first gradation-level converting means 13 does not use the ROM table. Instead, the first gradation-level converting means 13 directly outputs the gradation level of the input image signal of the N-th frame to the second and third gradation-level converting means 14 and 15 provided therebehind.

The second gradation-level converting means 14 converts the gradation level of the input image signal into a gradation level for the first sub-frame. Further, the third gradation-level converting means 15 converts the gradation level of the input image signal into a gradation level for the second sub-frame.

Figure 3:
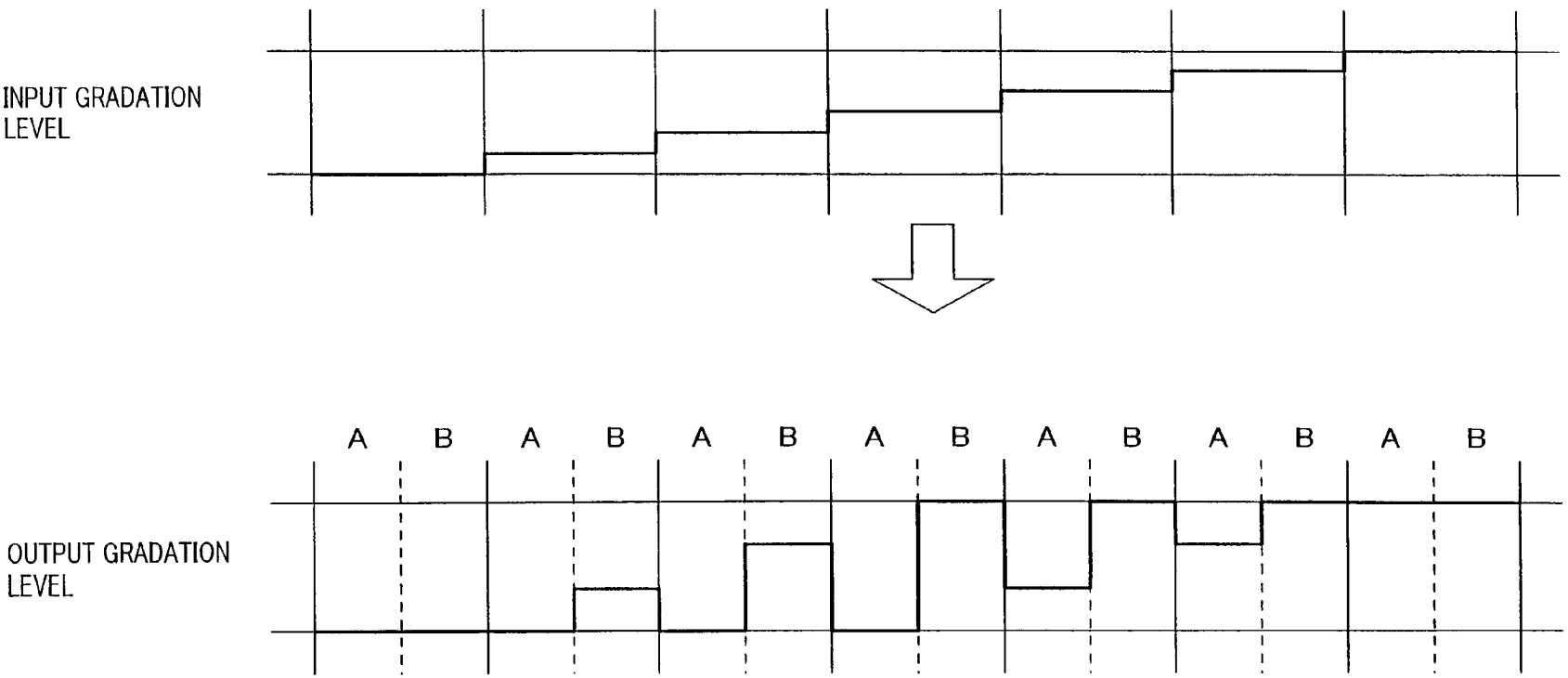
FIG. 3 is a diagram showing a relationship between an input gradation level and an output gradation level in an image display apparatus in which time-division driving is carried out.

That is, according to Embodiment 1, in cases where the gradation level of the input image signal is high, a gradation level of not less than 0 is allocated to both of the sub-frames. On this occasion, a reduction in contrast ratio is avoided by ensuring the greatest difference between an integral value of luminance obtained with the highest gradation level and an integral value of luminance obtained with the lowest gradation level. Further, as shown in FIG. 3, if at all possible, a high output gradation level is allocated to the second sub-frame and a low output gradation level is allocated to the first sub-frame. With this, an impulse is obtained. In FIG. 3, A indicates the output gradation level of the second gradation-level converting means 14 (the output gradation level of the first sub-frame), and B indicates the output gradation level of the third gradation-level converting means 15 (the output gradation level of the second sub-frame).

The following explains how the second gradation-level converting means 14 and the third gradation-level converting means 15 generate a gradation level signal for the first sub-frame and a gradation level signal for the second sub-frame, respectively. First, general display luminance (the luminance of an image displayed by the panel) concerning the image display panel (e.g., liquid crystal panel) 20 will be explained.

In cases where an image is displayed in one frame without use of a sub-frame in accordance with normal 8-bit data (in cases where such a normal hold display is carried out that all the gate lines of the image display panel 20 are turned ON only once in one frame period), the luminance gradation (signal gradation) of a display signal ranges from 0 to 255.

Then, the signal gradation and display luminance of the image display panel 20 are approximately expressed according to Formula (1):

$$((T-T0)/(T\max-T0))=(L/L\max)\hat{}\gamma \quad (1)$$

where L is the signal gradation (frame gradation) obtained in cases where an image is displayed in one frame (in cases where an image is displayed by carrying out a normal hold display); Lmax is the maximum luminance gradation (255); T is display luminance; Tmax is the maximum luminance (luminance obtained when L=Lmax=255; white); T0 is the minimum luminance (luminance obtained when L=0; black); and γ is the correction value (normally 2.2). Note that T0≠0 in an actual liquid crystal panel 21. However, for simplicity of explanation, the following assumes that T0=0.

The following explains the display luminance of the present image display apparatus. The present image display apparatus is designed so that the second gradation-level converting means 14 and the third gradation-level converting means 15 perform gradation expression so as to fulfill the following conditions (a) and (b):

(a) "A total (integral luminance in one frame) of the luminance (display luminance) of an image displayed both in a first-half sub-frame and a second-half sub-frame by the image display panel 20 is made equal to the display luminance of one frame which display luminance is obtained in cases where a normal hold display is carried out"; and (b) "One of the sub-frames is made black (minimum luminance) or white (maximum luminance)".

For this purpose, the present image display apparatus is designed so that one frame is equally divided into two sub-frames each of which displays a luminance up to half as high as the maximum luminance.

That is, in cases where a luminance up to half as high as the maximum luminance (threshold luminance; Tmax/2) is outputted in one frame (in case of a low luminance), such gradation expression is performed that only the display luminance of the second-half sub-frame is adjusted while the first-half sub-frame is at a minimum luminance (black) (gradation expression is preformed by using only the second-half sub-frame). In this case, the integral luminance in one frame is "(Minimum luminance+Luminance of second-half sub-frame)/2".

Further, in cases where a luminance higher than the threshold luminance is outputted (in case of a high luminance), such gradation expression is performed that the display luminance of the first-half sub-frame is adjusted while the second-half sub-frame is at a maximum luminance (white). In this case, the integral luminance in one frame is "Luminance of first-half sub-frame+Maximum luminance)/2".

The following provides concrete descriptions of a signal gradation setting for display signals (a previous-stage display signal and a next-stage display signal) for obtaining such a display luminance. It is assumed here that a frame gradation corresponding to the threshold luminance (Tmax/2) is calculated in advance by using Formula (1).

That is, a frame gradation (threshold luminance gradation; Lt) corresponding to such a display luminance is calculated in accordance with Formula (1) as follows:

$$Lt=0.5\hat{}(1/\gamma)\times L\max \quad (2)$$

$$\text{However, } L\max=T\max\hat{}\gamma \quad (2a)$$

Moreover, in cases where the first gradation-level converting means 13 outputs an image signal whose frame gradation L is not more than Lt, the second gradation-level converting means 14 refers to a ROM table provided therein, and then sets the luminance gradation (hereinafter referred to as "F") of a first sub-frame gradation level signal to a minimum (0). Meanwhile, the third gradation-level converting means 15 refers to a ROM table provided therein, and then sets the luminance gradation (hereinafter referred to as "R") of a second sub-frame gradation level signal in accordance with Formula (1) so that:

$$R=0.5\hat{}(1/\gamma)\times L \quad (3)$$

Further, in cases where the first gradation-level converting means 13 outputs an image signal whose frame gradation L is greater than Lt, the third gradation-level converting means 15 refers to a ROM table provided therein, and then sets the luminance gradation R of a second sub-frame gradation level signal to a maximum (255). Meanwhile, the second gradation-level converting means 14 sets the luminance gradation of a first sub-frame gradation level signal in accordance with Formula (1) so that:

$$F=(L\hat{}-0.5\times L\max\hat{}\gamma)\hat{}(1/\gamma) \quad (4)$$

The data selector 16 chooses between the output of the second gradation-level converting means 14 and the output of the third gradation-level converting means 15, and sends the chosen output to the image display panel 20. That is, the data selector 16 chooses and sends the output of the second gradation-level converting means 14 in a first-half sub-frame period, and chooses and sends the output of the third gradation-level converting means 15 in a second-half sub-frame period.

It is to be noted here that the image display apparatus 1 is designed to eliminate a pseudo contour that occurs due to a combination of (i) slow response speed of a display element and (ii) pseudo-impulse driving in the image display panel 20. Moreover, in order to attain the foregoing object, the image display apparatus 1 is characterized in that an overshoot driving mechanism is provided in front of a time-division gradation generation section and that a voltage (i.e., an output gradation level) at the time of overshoot driving is set so as to be suitable for pseudo-impulse driving. This feature is fully explained below.

Figure 1:
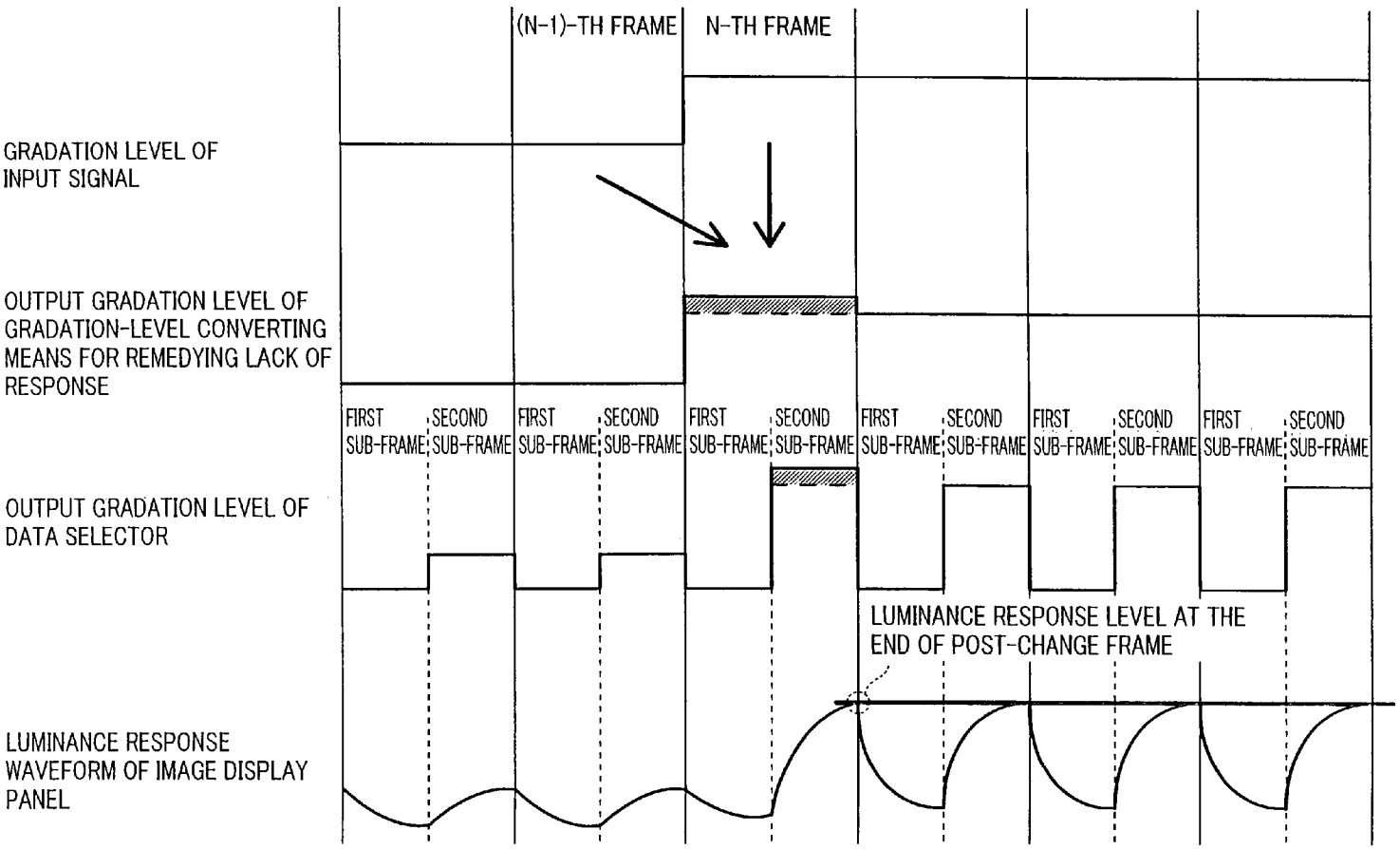
FIG. 1 shows an embodiment of the present invention, and is a waveform chart showing an example of an applied voltage setting used in carrying out overshoot driving in an image display apparatus according to Embodiment 1.

FIG. 1 shows an applied voltage setting used according to the simplest technique in carrying out overshoot driving in order to remedy the slow response speed of the display element.

The example shown in FIG. 1 represents a pixel (display element) in which the input signal gradation level greatly varies between the (N−1)-th frame and the N-th frame. That is, with respect to this pixel, the (N−1)-th frame is the last frame in which the gradation has not varied yet (such a frame being hereinafter referred to as "pre-change frame"), and the N-th frame is the first frame in which the gradation has just varied (such a frame being hereinafter referred to as "post-change frame").

It is assumed here that when a voltage corresponding to the input gradation level is applied, a predetermined luminance response level cannot be attained within in the N-th frame serving as a post-change frame. This is because the display element has low response speed. For this reason, overshoot driving is carried by correcting the input image signal with the first gradation-level converting means 13 and by increasing the output gradation level of the post-change frame. Further, by increasing the output gradation level of the first gradation-level converting means 13, the gradation level of a signal to be finally sent to the image display panel 20, i.e., the output gradation level of the data selector 16 is also increased by means of overshoot driving. In this case, the output of the second sub-frame, i.e., the output of the third gradation-level converting means 15 is made higher than the input gradation level. With this, in the image display panel 20, the luminance response level obtained at the end of the post-change frame can be matched to the luminance response level obtained at rest. Note that the term "at rest" used herein refers to a state in which there is no (or little) difference in the input gradation level of a pixel between successive frames. In the example shown in FIG. 1, the frames subsequent to the (N+1)-th frame is in a display state of rest.

In order to carry out the aforementioned overshoot driving in the image display apparatus 1, it is necessary that a table setting be carried out in advance in the first gradation-level converting means 13 by calculating a gradation level correction value.

It is first necessary, in calculating the gradation level correction value, to obtain a time waveform of display luminance that is attributed to the fact that the gradation level of an image signal given to the image display panel 20 varies every frame and every sub-frame. Such a time waveform of display luminance is obtained by means of simulation calculation or measurement.

For example, in cases where the image display panel 20 is a liquid crystal panel, simulation calculation can be carried out according to specifications such as (i) a driving voltage that an driver IC outputs to the panel in accordance with a given gradation level, (ii) response characteristics of the liquid crystal element, and (iii) a structure of the panel. Moreover, the simulation calculation makes it possible to obtain a time waveform of display luminance (luminance response waveform) that is attributed to the fact that the gradation level of an image signal given to the image display panel 20 varies every frame and every sub-frame.

Alternatively, a luminance response waveform of the image display panel 20 can be obtained by measuring a change in luminance of a given point or a certain range on the screen with use of (i) an element, such as a photodiode, which converts a received luminance into a voltage in real time and (ii) an apparatus, such as an oscilloscope, which can convert a measured voltage waveform into numerical data.

When a luminance response waveform is obtained in this way, the gradation level of an image signal given to the image display panel 20 is adjusted while observing the luminance response waveform. This makes it possible to obtain a value of gradation level that is to be supplied in each sub-frame so that a luminance level at a given point of time in each frame period or sub-frame period reaches the target level.

When a boundary portion between input gradation levels moves on the screen, a luminance distribution waveform as seen by the observer who follows the movement with his/her eyes can be obtained by calculating the luminance response waveform data obtained according to the aforementioned method or by actually measuring a luminance distribution.

In cases where a luminance distribution waveform as seen by the observer is obtained by means of calculation, the luminance distribution waveform is obtained by time-integrating, in the direction the observer follows with his/her eyes, the values of a plurality of points put on the luminance response waveform obtained according to the aforementioned method.

Figure 4:
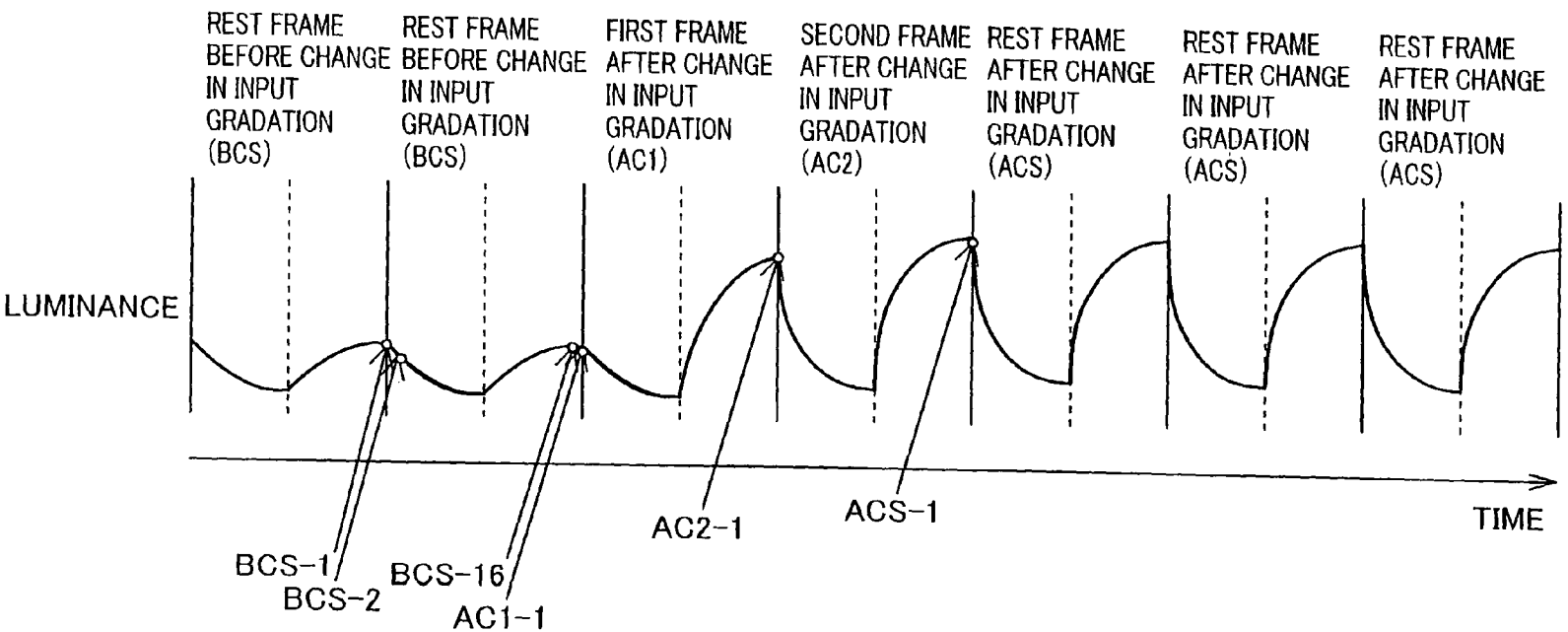
FIG. 4 is a waveform chart showing a luminance response waveform of an image display panel.

For example, see a case of an image display panel having such response speed performance that when two frame periods has elapsed since a change in input gradation, a luminance response waveform is obtained which is equivalent to a luminance response waveform obtained when the input is at rest. In this case, first, the values of N points (e.g., 16 points) of waveform data in each of (i) a rest frame before a change in input gradation (BCS), (ii) a first frame after the change in input gradation (AC1), (iii) a second frame after the change in input gradation (AC2), and (iv) a rest frame after the change in input gradation (ACS) are acquired, the four frames being selected from among the luminance response waveform (see FIG. 4) obtained according to the aforementioned method.

Figure 5:
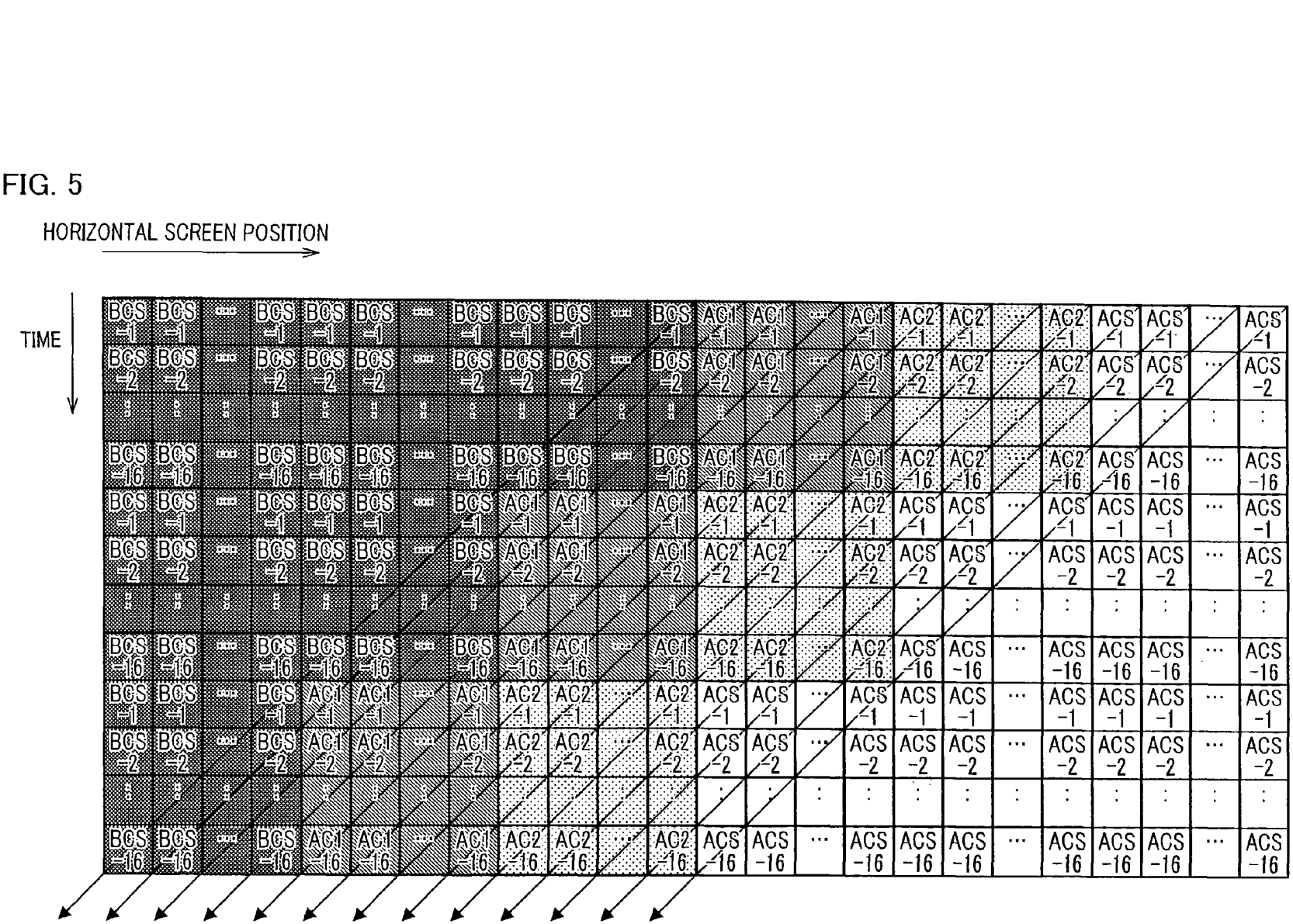
FIG. 5 explains a process of finding a luminance distribution waveform as seen by the observer, and is a diagram in which the values of points acquired from luminance response waveform data are arrayed.

Next, the values of points on the acquired luminance response waveform data are arrayed assuming an moving image in which a boundary portion between two input gradations moves, so as to correspond to a change in luminance caused in each horizontal screen position (see FIG. 5). The values of points thus arrayed are integrated in the direction the observer follows with his/her eyes, and the total of the values of points is divided by the number of the points thus integrated. On this occasion, assuming N (e.g., 16) points/frame equivalent to the number of the points acquired during one frame period, the speed at which the boundary portion moves can be calculated according to a method of integrating one by one the acquired values of points in an oblique direction shown in the table of FIG. 5.

Thus, by calculating integral values corresponding to a horizontal position as seen by the observer and plotting them on a graph, a luminance distribution waveform as seen by the observer is obtained.

Further, in cases where a luminance distribution waveform as seen by the observer is obtained by means of measurement, such a method as described below can be used. That is, an apparatus, such as a CCD (Charge-Coupled Device), which can measure a distribution of time-integral values of luminance within a given area is moved in parallel with the boundary portion, or is caused to oscillate so as to follow the boundary portion. With this, the luminance of the vicinity of the boundary portion is measured. This makes it possible to obtain a luminance distribution waveform of a boundary portion between two input gradations within a given period of time and of the vicinity thereof.

Figure 7:
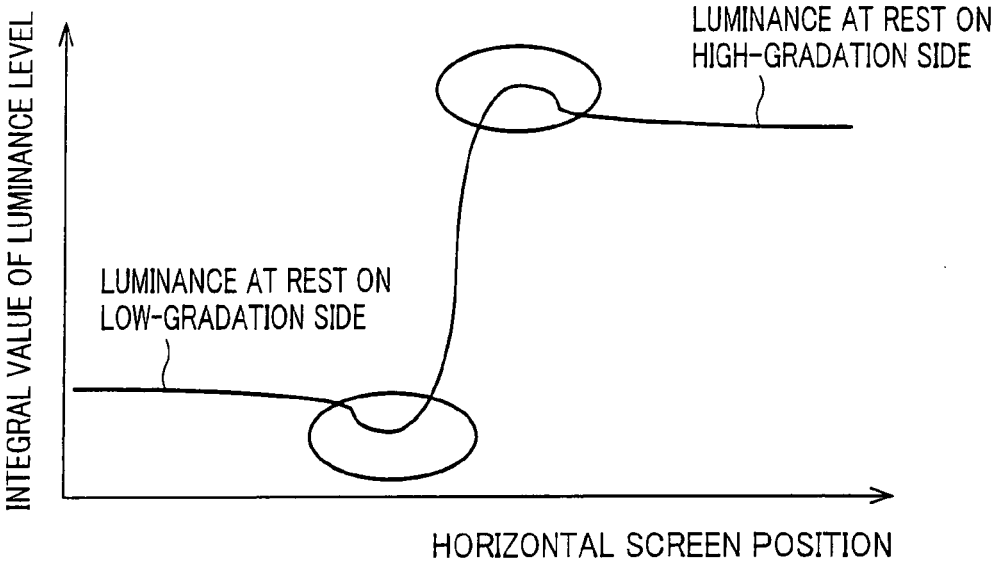
FIG. 7 is a waveform showing a luminance distribution waveform obtained in cases where there occurs a display exceeding the target luminance in the vicinity of a boundary that moves.
Figure 17:
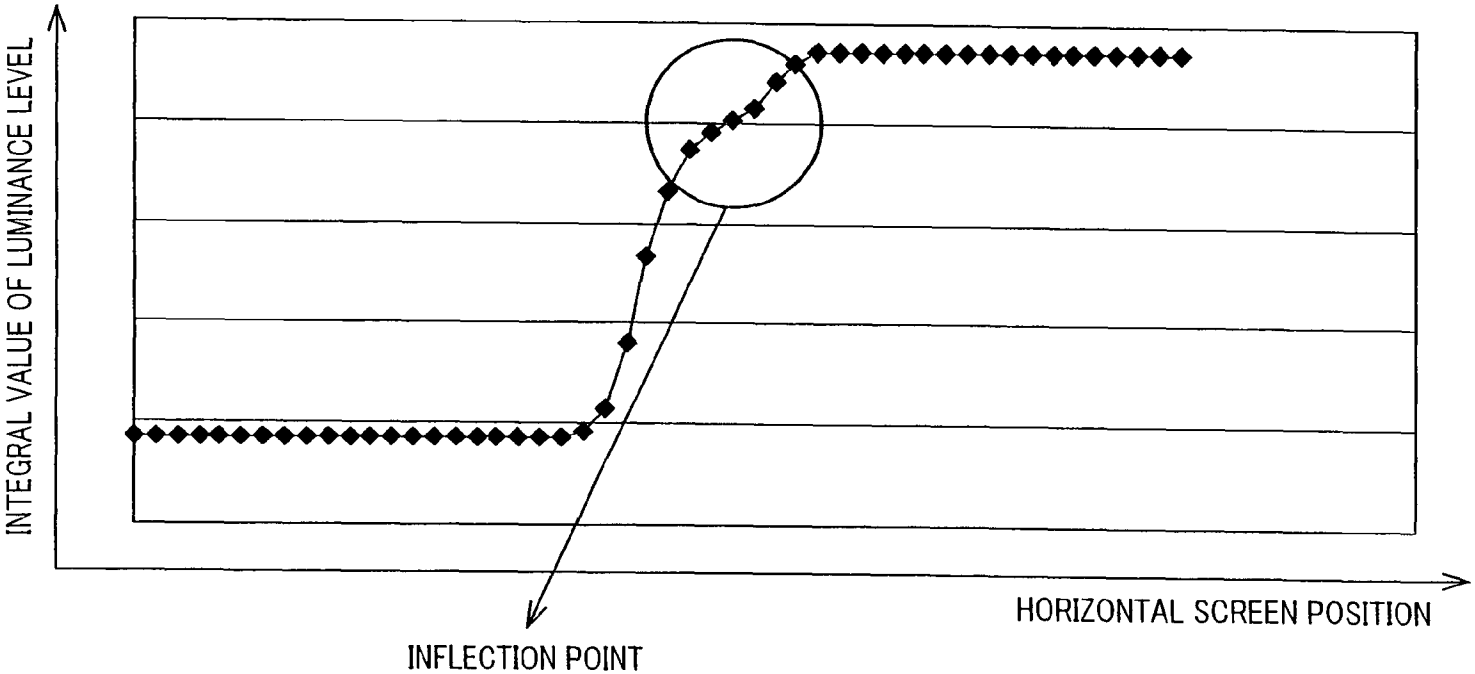
FIG. 17 is a waveform chart showing an example of a luminance distribution waveform, as seen by the observer, which is obtained from a display apparatus whose display element has low response speed.

For example, as shown in FIG. 17, a luminance distribution waveform obtained in this way may have an inflection point in the middle of a curve connecting two luminances at rest. Alternatively, as shown in FIG. 7, a luminance distribution waveform obtained in this way may have a point lower than the luminance at rest obtained on the side of low gradation and a point higher than the luminance at rest obtained on the side of high gradation. An inflection point causes a pseudo contour, and an integral luminance much lower or higher than at rest causes such deterioration in image quality as excessive brightness or excessive darkness. Therefore, when the gradation level of an image signal supplied to the image display panel 20 is adjusted while feeding back a result of observation of a luminance distribution waveform, such a gradation level can be obtained that a luminance distribution waveform is prevented from having an inflection point or an integral luminance much higher or lower than at rest. Therefore, it is only necessary that the gradation level thus determined be used as a value that is to be set in the table of the first gradation-level converting means 13, i.e., as a gradation level that is to be outputted at the time of overshoot driving.

Figure 8:
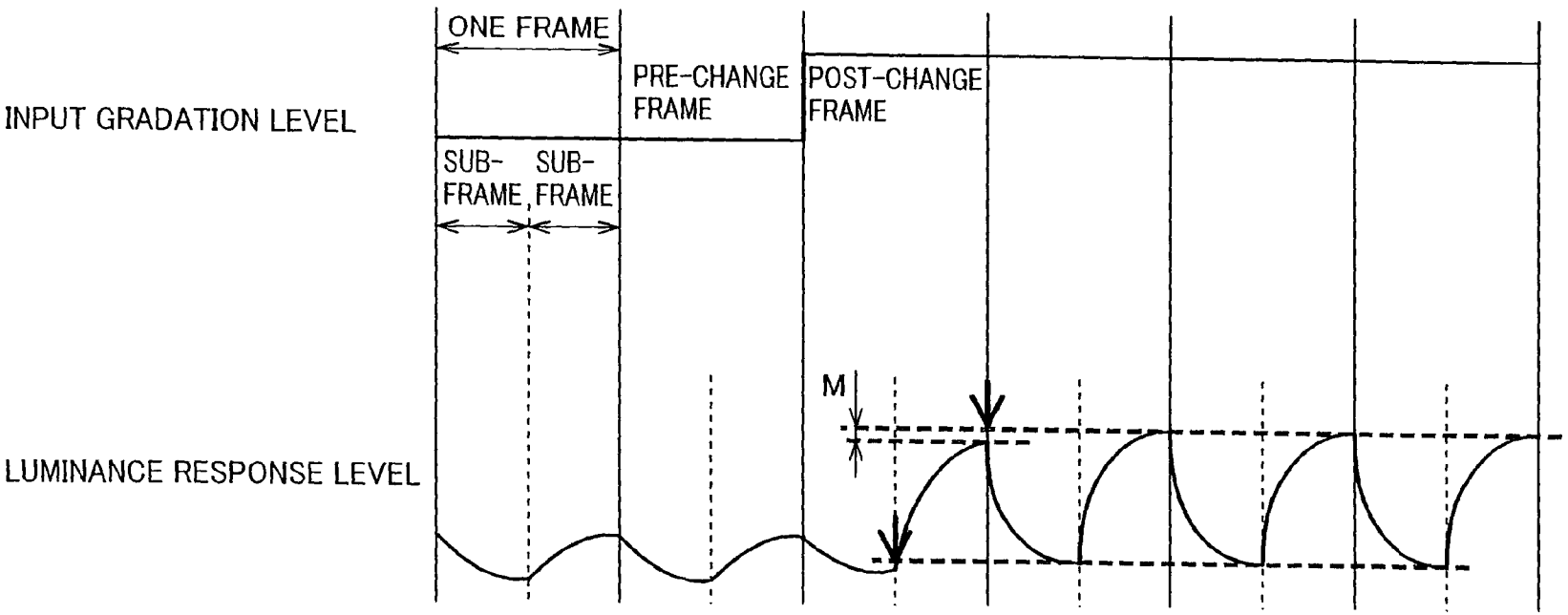
FIG. 8 is a waveform chart showing an example of a luminance response waveform obtained in cases where overshoot driving is carried out in an image display panel.

Note that if the first gradation-level converting means 13 contains converted gradation values corresponding to all the input gradations, it is possible to make such gradation corrections to all the input gradations. However, the storage of the converted gradation values corresponding to all the input gradations requires a ROM serving as gradation-level converting means to have very large capacity, thereby causing a cost increase. In view of this, it is conceivable that a cost increase is prevented, for example, by limiting the number of bits that are to be inputted to the gradation-level converting means and by storing only converted gradation values obtained by means of measurement or calculation based on some representative values. This raises a question of to what extent a margin of error is allowed with respect to the input of a gradation value other than the representative values. It is conceivable, as shown in FIG. 8, that the allowable margin of error is set by providing a predetermined margin M with respect to the luminance response level at rest. Further, in the example shown in FIG. 8, the margin M is set only at the end of the post-change frame (i.e., at the end of the last sub-frame of the post-change frame). However, the margin M may be set at the end of each sub-frame of the post-change frame.

In the present embodiment, the margin M is set to be an error range of not more than 10% of the difference between the maximum and minimum luminance levels of the image display panel. In the present embodiment, the aforementioned error range can also be ensured according to a method of inputting a gradation signal of the N-th frame and a gradation signal of the (N−1)-th frame to the first gradation-level converting means serving as gradation-level converting means at the time of overshoot driving, each of the gradation signals corresponding only to the high 4 bits of the original input gradation signal with its low 4 bits ignored, and of storing only converted values corresponding to such changes in input gradation that one gradation differs from another gradation by 16 gradations. With this, the ROM capacity of the gradation converting means can be saved more than by storing converted gradation values corresponding to all the input gradations, so that circuit cost is reduced.

The arrangement of the gradation converting means is not limited to this, but is changed in accordance with what error range is set with respect to the target level of attained luminance. The error range with respect to the target level of attained luminance depends, for example, on (i) the cost for the gradation converting means and (ii) the accuracy in measurement of the converted gradation values. In this description, however, examples of the standard under which the margin M is set include the following standards (1) to (3):

(1) The margin M is set to be not more than 10%, or more preferably not more than 3%, of the difference between the minimum and maximum luminance levels of the image display panel;

(2) In case of an increase in luminance, the margin M is set to be not more than 15%, or more preferably not more than 5%, of the difference between the minimum luminance level of the image display panel and the target luminance (at rest). Note that the term "case of an increase in luminance" refers to a case where the luminance of a post-change frame is higher than the luminance of a pre-change frame; and (3) In case of a decrease in luminance, the margin M is set to be not more than 15%, or more preferably not more than 5%, of the difference between the maximum luminance level of the image display panel and the target luminance (at rest). Note that the term "case of a decrease in luminance" refers to a case where the luminance of a post-change frame is lower than the luminance of a pre-change frame.

Embodiment 2

In the image display apparatus 1 according to Embodiment 1 described above, the first gradation-level converting means 13 carries out overshoot driving for compensating for the lack of response of the image display panel 20. That is, in the image display apparatus 1, a gradation level correction for carrying out overshoot driving is made with respect to an input gradation signal representing the display gradation level of the whole frame.

Moreover, the second and third gradation-level converting means 14 and 15 for generating a gradation level signal for each sub-frame only convert, for sub-frames divided from each other, a gradation level signal whose gradation level has been corrected.

For this reason, in the image display apparatus 1 according to Embodiment 1, a gradation level correction for overshoot driving is made only in a post-change frame, nor is it possible to set in which sub-frame of the post-change frame overshoot driving is to be carried out. However, a preferable display can be obtained by carrying out overshoot driving including selecting a sub-frame in which a gradation level correction is to be made.

Embodiment 2 of the present invention will be described below with reference to the drawings. An image display apparatus according to Embodiment 2 enables overshoot driving including selecting a sub-frame in which a gradation level correction is to be made. First, an arrangement of an image display apparatus 2 according to Embodiment 2 will be described below with reference to FIG. 9.

Figure 9:
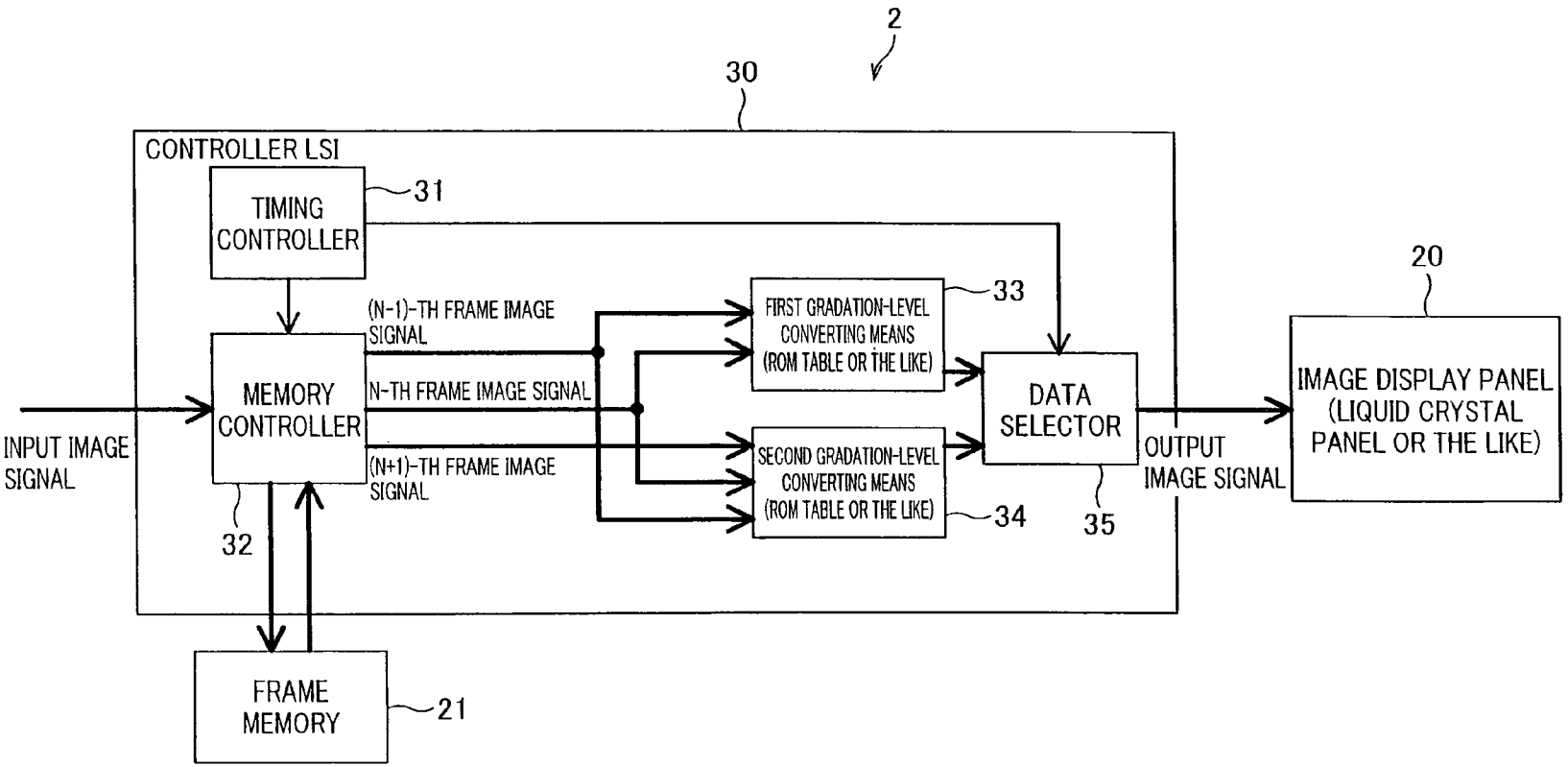
FIG. 9 is a block diagram schematically showing an arrangement of an image display apparatus according to Embodiment 2.

As shown in FIG. 9, the image display apparatus 2 includes a controller LSI 30, an image display panel 20, and a frame memory 21. That is, an input image signal inputted to the image display apparatus 2 (e.g., from an external apparatus, such as a personal computer, connected thereto) is processed in the controller LSI 30, and then is outputted as an output image signal to the image display panel 20. The image display panel 20 carries out a display in accordance with the output image signal sent from the controller LSI 30.

The controller LSI 30 includes a timing controller 31, a memory controller 32, first gradation-level converting means 33, second gradation-level converting means 34, and a data selector 35.

The timing controller 31 generates a timing signal for controlling the memory controller 32 and the data selector 35. In accordance with the timing signal generated by the timing controller 31, the controller LSI 30 time-divides a 60 Hz input frame period into two sub-frames: a first sub-frame period and a second sub-frame period.

In accordance with the timing signal sent from the timing controller 31, the memory controller 32 carries out the following time-division operations (1) to (4):

(1) An input image signal having a predetermined frame frequency (e.g., 60 Hz) is written in the frame memory 21;

(2) An image signal of the (N−1)-th frame which image signal has been written in the frame memory 21 is read out twice at a frequency twice as high (e.g., 120 Hz) as the frame frequency at which the input image signal was written in, and then is transferred to the first gradation-level converting means 33 and the second gradation-level converting means 34;

(3) An image signal of the N-th frame which image signal has been written in the frame memory 21 is read out twice at a frequency twice as high (e.g., 120 Hz) as the frame frequency at which the input image signal was written in, and then is transferred to the first gradation-level converting means 33 and the second gradation-level converting means 34; and (4) An image signal of the (N+1)-th frame which image signal has been written in the frame memory 21 is read out twice at a frequency twice as high (e.g., 120 Hz) as the frame frequency at which the input image signal was written in, and then is transferred to the second gradation-level converting means 34.

In accordance with the image signal of the (N−1)-th frame and the image signal of the N-th frame, the first gradation-level converting means 33 generates a gradation level signal for a first sub-frame of the N-th frame. Further, in accordance with the image signal of the (N−1)-th frame, the image signal of the N-th frame, and the image signal of the (N+1)-th frame, the second gradation-level converting means 34 generates a gradation level signal for a second sub-frame of the N-th frame.

That is, the first gradation-level converting means 33 and the second gradation-level converting means 34 not only divide, into gradation level signals for sub-frames, an input image signal indicative of a certain gradation level in one frame period, but also perform a process of making a gradation level correction for overshoot driving in a frame where there occurs a change in gradation of the input image signal.

Figure 10:
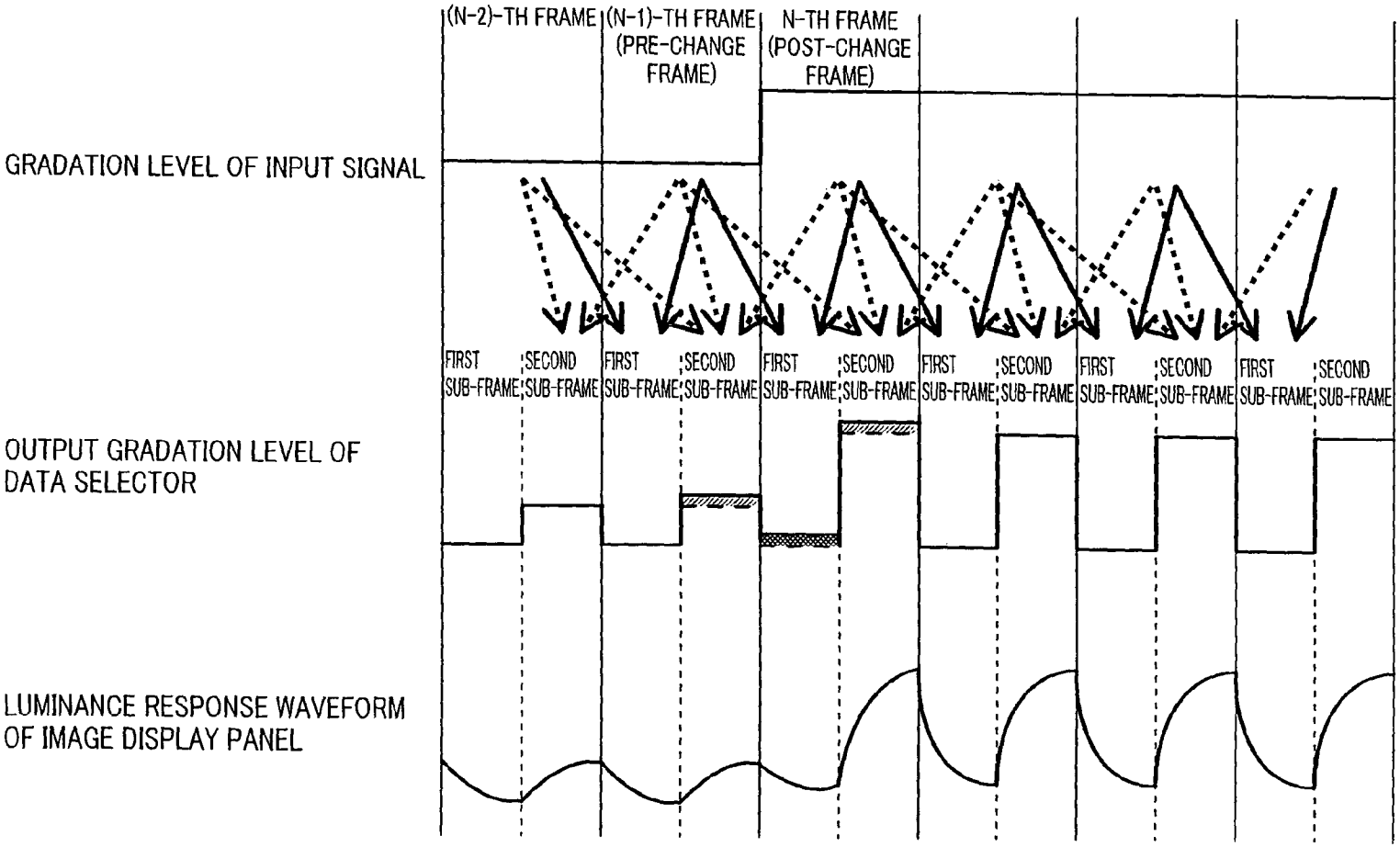
FIG. 10 is a waveform chart showing an example of an applied voltage setting used in carrying out overshoot driving in the image display apparatus according to Embodiment 2.

In the arrangement of the image display apparatus 2 according to Embodiment 2, as shown in FIG. 10, each of the first gradation-level converting means 33 and the second gradation-level converting means 34 receives a plurality of successive frame image signals. This enables each of the first gradation-level converting means 33 and the second gradation-level converting means 34 to detect a change in gradation level, thereby making it possible to make a gradation level correction for overshoot driving. In other words, the arrangement of the image display apparatus 2 makes it possible to freely set in which sub-frame of a post-change frame overshoot driving is to be carried out, and further makes it possible to make a gradation level correction for overshoot driving in a pre-change frame as well as the post-change frame.

The data selector 35 chooses between the output of the first gradation-level converting means 33 and the output of the second gradation-level converting means 34, and sends the chosen output to the image display panel 20. That is, the data selector 35 chooses and sends the output of the first gradation-level converting means 33 in a first-half sub-frame period, and chooses and sends the output of the second gradation-level converting means 34 in a second-half sub-frame period.

Figure 11:
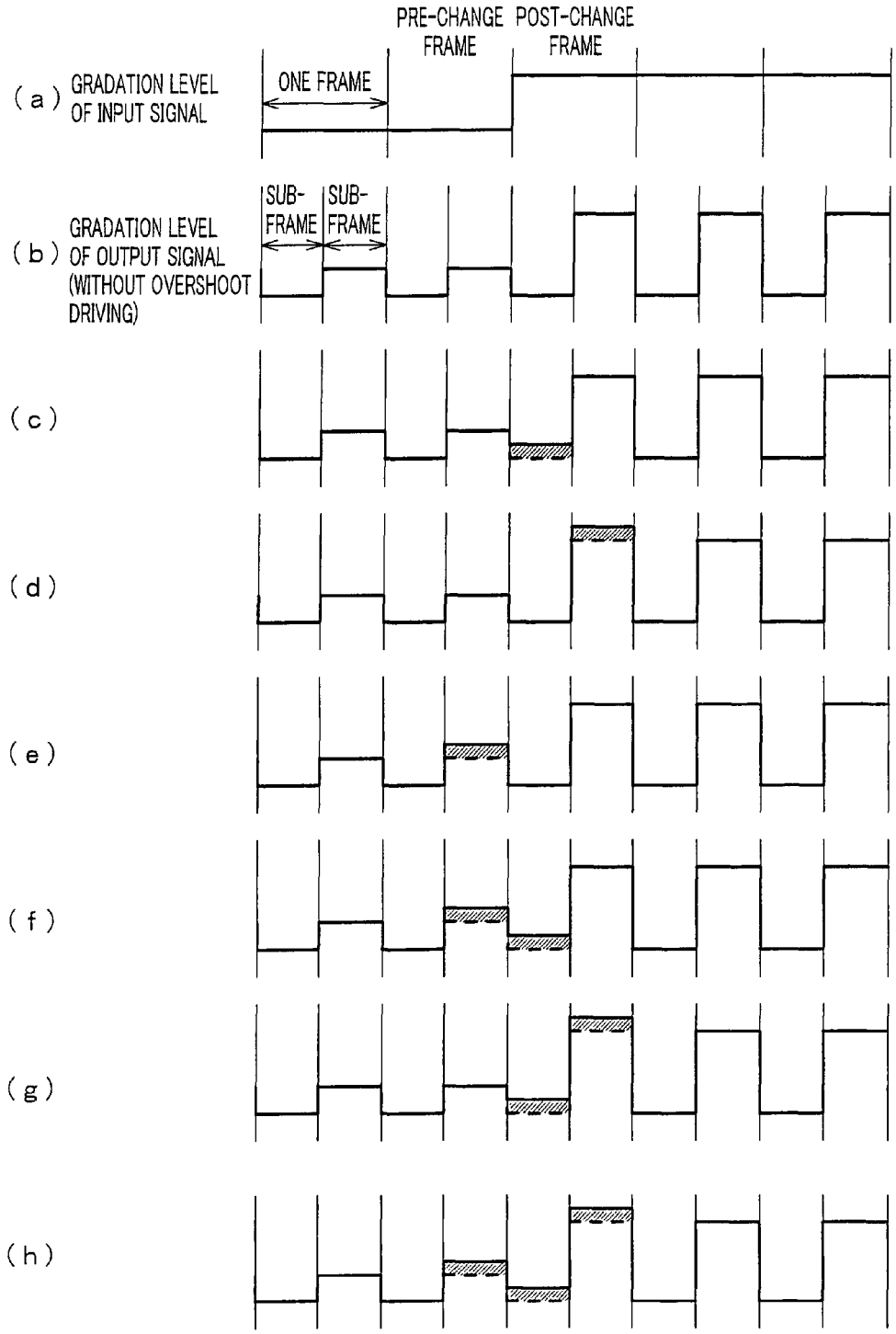
FIG. 11 shows examples of gradation level correction made in carrying out overshoot driving in the image display apparatus according to Embodiment 2.
Figure 12:
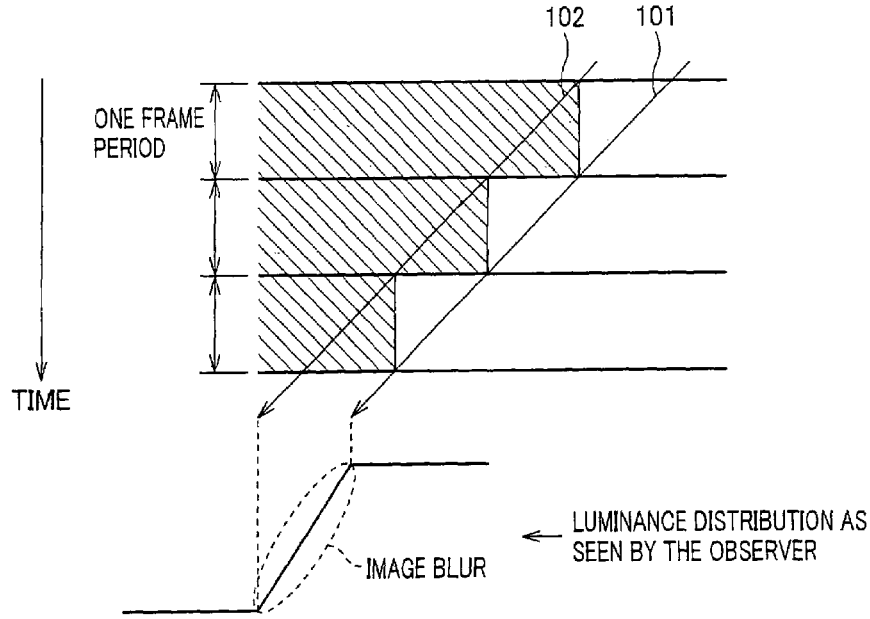
FIG. 12(*a*) is a diagram showing how a boundary between two regions of different luminance moves at the time of hold driving.
Figure 12:
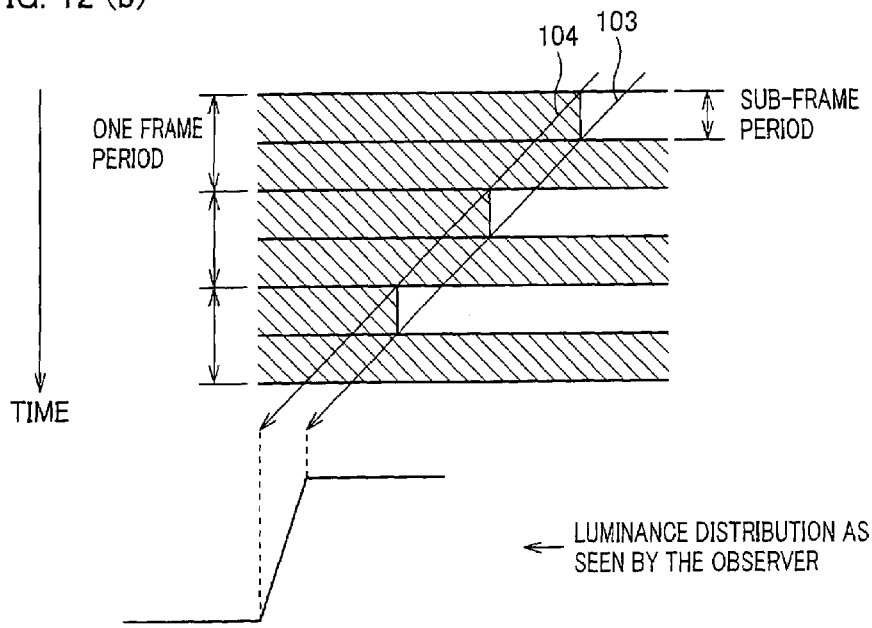
Figure 13:
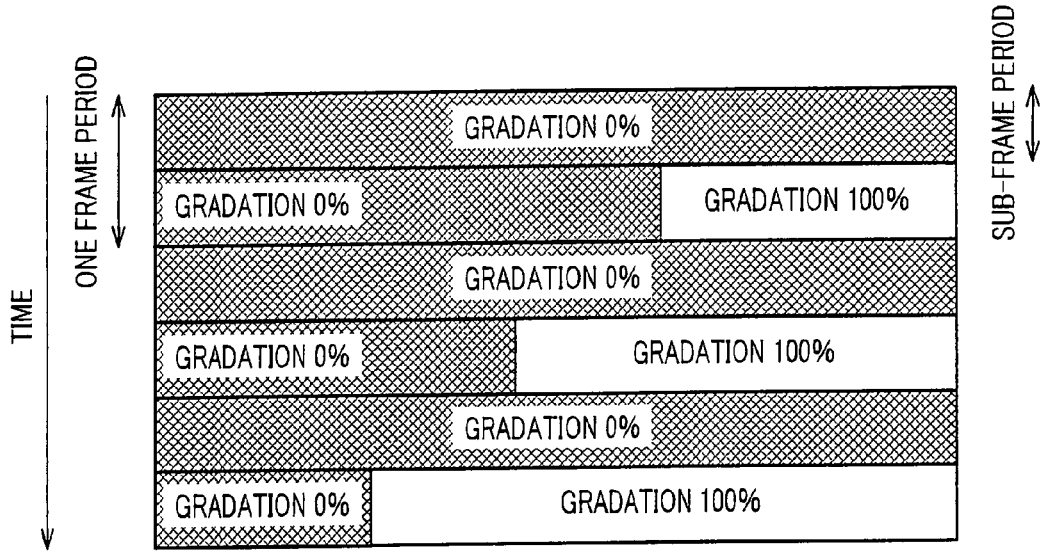
FIG. 13 is a diagram showing how a boundary between regions moves at the time of pseudo-impulse driving.
Figure 14:
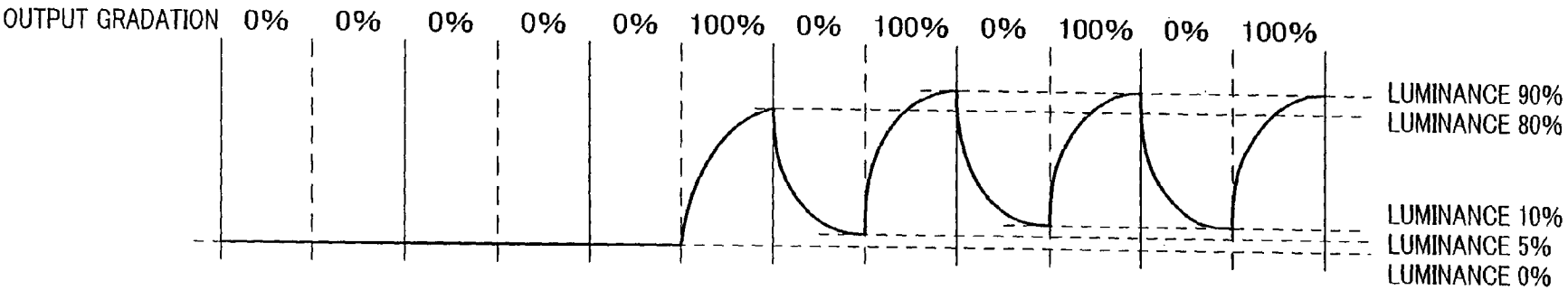
FIG. 14 is a waveform chart showing luminance response obtained in cases where a luminance corresponding to a gradation signal is not attained due to the slow response speed of a display element.
Figure 15:
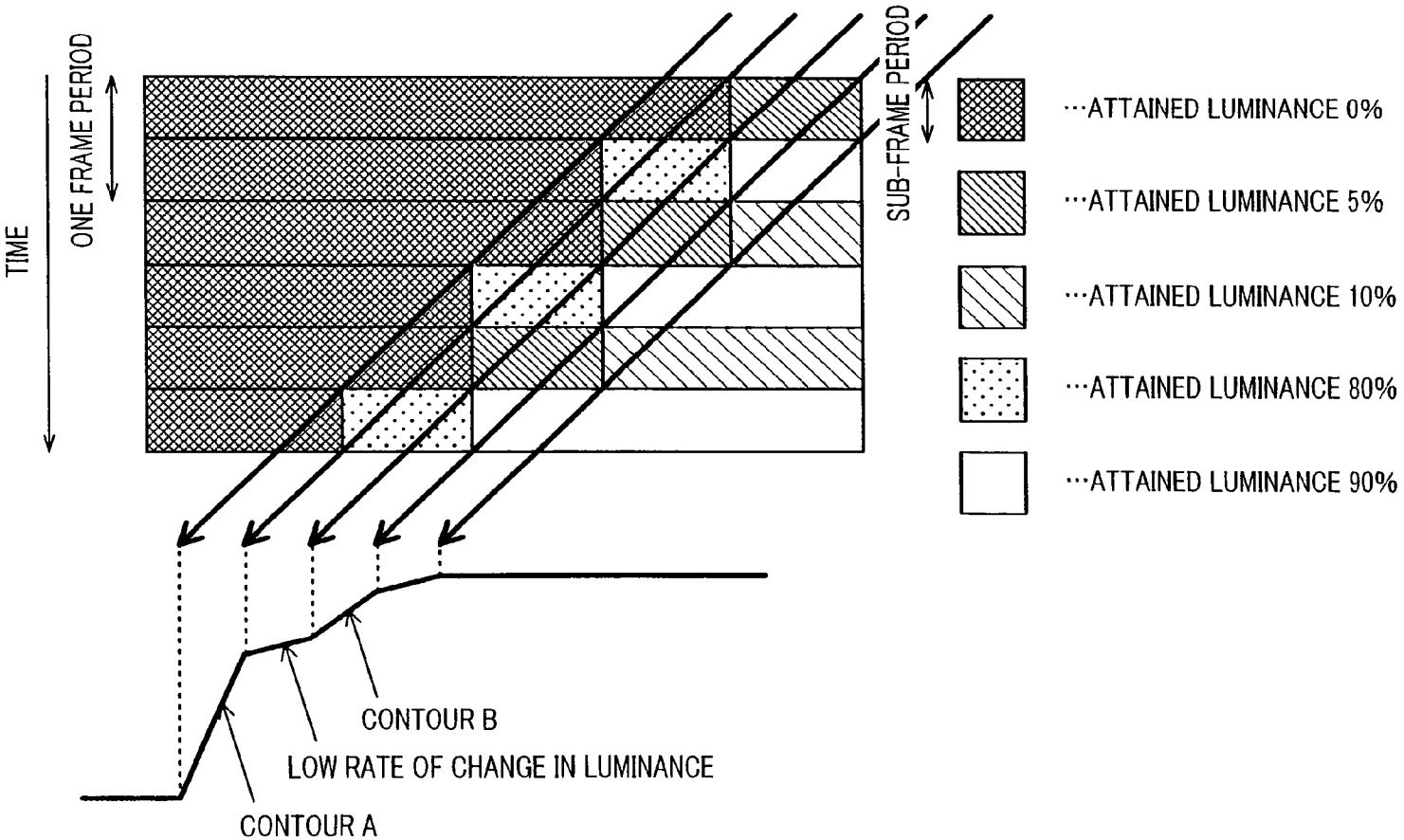
FIG. 15 is a diagram showing why a pseudo contour occurs due to pseudo-impulse driving in a display apparatus whose display element has low response speed.
Figure 16:
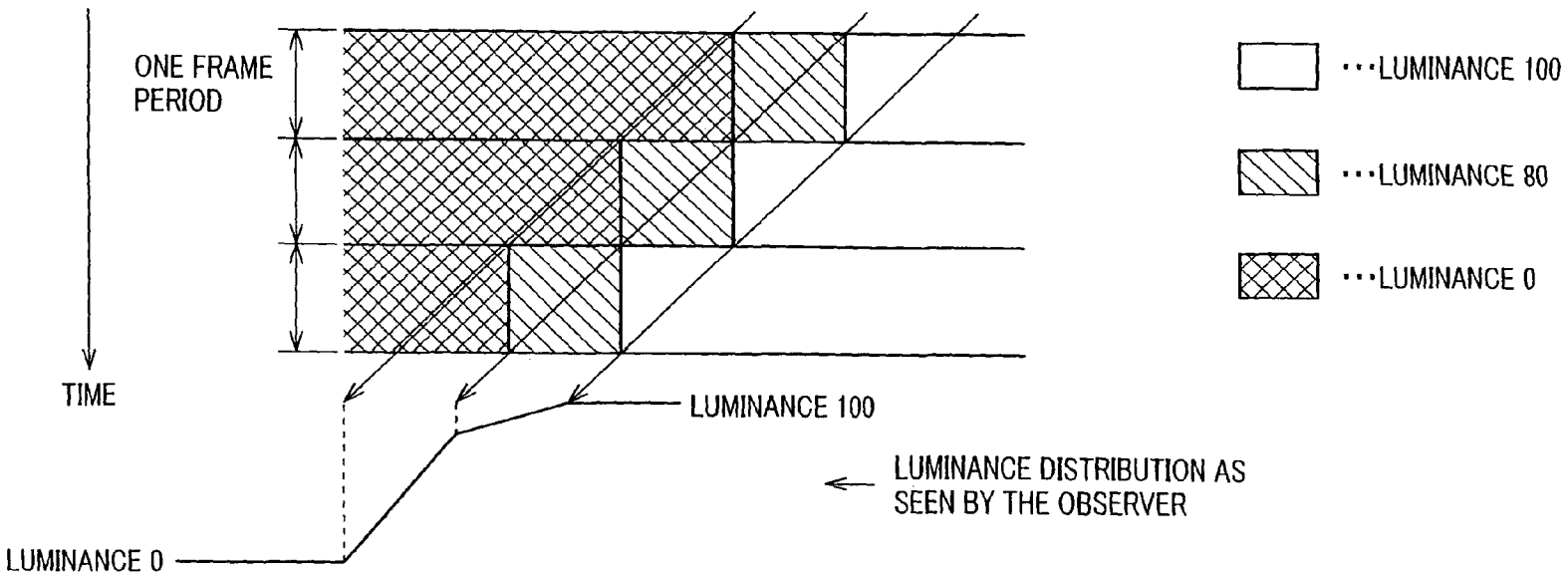
FIG. 16 is a diagram explaining a luminance distribution obtained in cases where hold driving is carried out in a display apparatus whose display element has low response speed.

FIG. 11 shows examples of gradation level correction made in carrying out overshoot driving in the image display apparatus 2 according to Embodiment 2. (a) shows the gradation level of an input signal. Further, (b) shows an output gradation level obtained when time-division driving is simply carried out instead of overshoot driving.

(c) shows an example in which the gradation level is corrected (i.e., made higher or lower than at rest) in the first sub-frame of the post-change frame.

(d) shows an example in which the gradation level is corrected (i.e., made higher or lower than at rest) in the last sub-frame of the post-change frame.

(e) shows an example in which the gradation level is corrected (i.e., made higher or lower than at rest) in the last sub-frame of the pre-change frame.

(f) shows an example in which the gradation level is corrected (i.e., made higher or lower than at rest) both in the last sub-frame of the pre-change frame and the first sub-frame of the post-change frame.

(g) shows an example in which the gradation level is corrected (i.e., made higher or lower than at rest) in the first and last sub-frames of the post-change frame.

(h) shows an example in which the gradation level is corrected (i.e., made higher or lower than at rest) both in the last sub-frame of the pre-change frame and the first and last sub-frames of the post-change frame.

Figure 6:
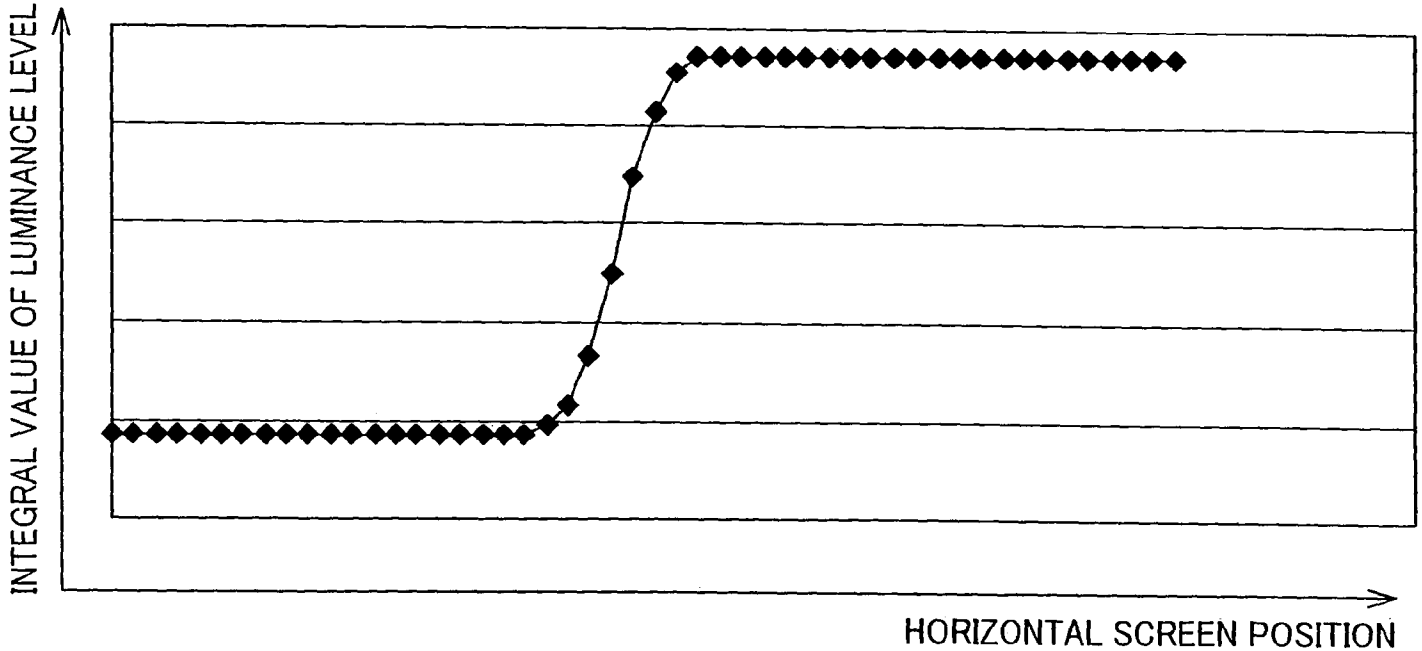
FIG. 6 is a waveform chart showing an ideal luminance distribution waveform in the vicinity of a boundary that moves.

A comparison among the example gradation level corrections respectively shown in (c) to (h) of FIG. 11 shows that more accurate overshoot driving is achieved by examples (f) and (g) in which a gradation level correction is made using two sub-frames than by example (c) to (e) in which a gradation level correction is made in one sub-frame, and that even more accurate overshoot driving is achieved by example (h) in which a gradation level correction is made using three sub-frames than by example (f) and (g). This makes it possible to obtain a luminance distribution waveform closer to the ideal luminance distribution waveform (see FIG. 6).

A comparison among examples (c) to (e) (or (f) and (g)) of FIG. 11 shows that it is not easy to determine their relative merits. However, more accurate overshoot driving is enabled if a sub-frame in which a gradation level correction is to be made is appropriately selected by using a combination of the gradation level of the pre-change frame and the gradation level of the post-change frame.

As with Embodiment 1, in the image display apparatus 2 according to Embodiment 2, the table values in the first gradation-level converting means 33 and in the second gradation-level converting means 34 can be set by providing a predetermined margin M between (i) the luminance response level obtained when a gradation level correction for carrying out overshoot driving has been made and (ii) the luminance response level obtained at rest.

In each of Embodiments 1 and 2 described above, each gradation-level converting means is a ROM table. However, the present invention is not limited to this. An arithmetic circuit for calculating the output gradation level of each sub-frame from the input gradation level or a combination of a ROM table and an arithmetic circuit may be used. Further, software may be used instead of an arithmetic circuit to calculate the output gradation level of each sub-frame from the input gradation level.

Further, in each of Embodiments 1 and 2 described above, the arrangement may be such that the image display apparatus includes temperature detecting means and that the output gradation level is adjusted in accordance with the ambient temperature detected by the temperature detecting means.

Further, each of Embodiments 1 and 2 described above illustrates a case where the number of sub-frames into which a frame is divided is 2. However, the number of sub-frames into which a frame is divided is not limited to this. For example, a frame may be divided into three or more sub-frames. Further, sub-frames do not need to be equally divided from each other at a ratio of 1:1. A frame can be divided into sub-frames at a given ratio (e.g., 2:1 or 3:2).

The image display apparatus according to each of Embodiments 1 and 2 described above, can be caused to function as an image display monitor such as a liquid crystal monitor, and can be caused to function as a television receiver. Furthermore, it can be used for a screen-integrated personal computer, a portable terminal, and an on-board display apparatus.

The image display apparatus can be caused to function as an image display monitor by providing a signal input section (e.g., an input port) for inputting an externally inputted image signal to the control LSI. Meanwhile, the image display apparatus can be caused to function as a television receiver by providing the image display apparatus with a tuner section. This tuner section selects a channel for a television broadcast signal, and inputs a television image signal of the selected channel to the control LSI as an input image signal.

As described above, an image display apparatus according to the present invention is an image display apparatus for displaying an image by time-dividing one frame period of an input image signal into a plurality of sub-frame periods, including: correcting means for, with respect a pixel in which a gradation level varies by not less than a predetermined value between successive frames, correcting the gradation level in such a direction that response speed of the pixel is increased; and allocating means for, in accordance with an image signal whose gradation level has been corrected by the correction section, allocating a luminance to each sub-frame so that a total of time-integral values of luminance of each sub-frame within one frame period reproduces a luminance of one frame period which luminance is based on the input image signal.

Further, the image display apparatus can be arranged such that the correcting means corrects the gradation level so that a luminance obtained at the end of each sub-frame of a frame in which the gradation level has just varied coincides with a luminance that is to be obtained at the end of each sub-frame when an uncorrected gradation level is at rest.

In cases where the gradation level varies between the frames compared with each other, the application of a voltage corresponding to the input gradation level in the post-change frame does not make it possible to attain a predetermined luminance response level (i.e., a luminance response level attained at rest where there is no (or little) difference in gradation level between the frames) within the frame period in an image display panel (e.g., a liquid crystal panel) whose display element (pixel) has low response speed. Especially, in cases where an image is displayed by time-dividing one frame period into a plurality of sub-frame periods, the display element must finish responding within each sub-frame period. As a result, the foregoing problems become more prominent.

According to the foregoing arrangement, overshoot driving for remedying the slow response speed of the pixel can be carried out in such an image display apparatus by correcting the input image signal with the correcting means and by correcting the output gradation level of the post-change frame.

Moreover, the allocating means allocates a display luminance to each sub-frame in accordance with the image signal whose gradation level has been corrected by the correcting means, so that the luminance response level at the end of the post-change frame can be matched to the luminance response level at rest.

Another image display apparatus according to the present invention is an image display apparatus for displaying an image by time-dividing one frame period of an input image signal into a plurality of sub-frame periods, including: sub-frame signal generating means for correcting a gradation level with respect to a pixel in which the gradation level varies between successive frames, and for generating a sub-frame signal by allocating a luminance to each sub-frame so that a total of time-integral values of luminance of each sub-frame within one frame period reproduces a luminance of one frame period which luminance is based on the input image signal.

According to the foregoing arrangement, overshoot driving for remedying the slow response speed of the pixel can be carried out by correcting the input image signal with the sub-frame signal generating means and by correcting the output gradation level of the post-change frame. Each sub-frame signal is generated by allocating a display luminance to each sub-frame, so that the luminance response level at the end of the post-change frame can be matched to the luminance response level at rest.

Furthermore, it is possible to randomly set in which sub-frame of the post-change frame overshoot driving is to be carried out. Further, a gradation level correction for overshoot driving can be made in the pre-change frame as well as the post-change frame. That is, overshoot driving including selecting a sub-frame in which a gradation level correction is to be made can be carried out. As a result, a more preferable display can be obtained.

Further, the image display apparatus can be arranged such that with respect to the pixel in which the gradation level varies by not less than a predetermined value between successive frames, the correcting means or the sub-frame signal generating means corrects the gradation level so that a difference between (i) a luminance obtained at the end of each sub-frame of a frame in which the gradation level has just varied and (ii) a target luminance that is to be obtained at the end of each sub-frame when an uncorrected gradation level is at rest is not more than 10% of a difference between (a) a minimum luminance level of an image display panel and (b) a maximum luminance level of the image display panel.

Further, the image display apparatus can be arranged such that with respect to the pixel in which the gradation level varies by not less than a predetermined value between successive frames, the correcting means or the sub-frame signal generating means corrects the gradation level so that a difference between (i) a luminance obtained at the end of each sub-frame of a frame in which the gradation level has just varied and (ii) a target luminance that is to be obtained at the end of each sub-frame when an uncorrected gradation level is at rest is not more than 3% of a difference between (a) a minimum luminance of an image display panel and (b) a maximum luminance of the image display panel.

Further, the image display apparatus can be arranged such that with respect to the pixel in which the gradation level varies by not less than a predetermined value between successive frames, the correcting means or the sub-frame signal generating means corrects the gradation level so that when there is an increase in luminance as a result of the change, a difference between (i) a luminance obtained at the end of each sub-frame of a frame in which the gradation level has just varied and (ii) a target luminance that is to be obtained at the end of each sub-frame when an uncorrected gradation level is at rest is not more than 15% of a difference between (a) a minimum luminance level of an image display panel and (b) the target luminance.

Further, the image display apparatus can be arranged such that with respect to the pixel in which the gradation level varies by not less than a predetermined value between successive frames, the correcting means or the sub-frame signal generating means corrects the gradation level so that when there is an increase in luminance as a result of the change, a difference between (i) a luminance obtained at the end of each sub-frame of a frame in which the gradation level has been changed and (ii) a target luminance that is to be obtained at the end of each sub-frame when an uncorrected gradation level is at rest is not more than 5% of a difference between (a) a minimum luminance level of an image display panel and (b) the target luminance.

Further, the image display apparatus can be arranged such that with respect to the pixel in which the gradation level varies by not less than a predetermined value between successive frames, the correcting means or the sub-frame signal generating means corrects the gradation level so that when there is a decrease in luminance as a result of the change, a difference between (i) a luminance obtained at the end of each sub-frame of a frame in which the gradation level has just varied and (ii) a target luminance that is to be obtained at the end of each sub-frame when an uncorrected gradation level is at rest is not more than 15% of a difference between (a) a maximum luminance level of an image display panel and (b) the target luminance.

Further, the image display apparatus can be arranged such that with respect to the pixel in which the gradation level varies by not less than a predetermined value between successive frames, the correcting means or the sub-frame signal generating means corrects the gradation level so that when there is a decrease in luminance as a result of the change, a difference between (i) a luminance obtained at the end of each sub-frame of a frame in which the gradation level has been changed and (ii) a target luminance that is to be obtained at the end of each sub-frame when an uncorrected gradation level is at rest is not more than 5% of a difference between (a) a maximum luminance level of an image display panel and (b) the target luminance.

It is conceivable that the cost of a gradation converting circuit can be reduced by making such an arrangement that only converted values corresponding to some representative values are prepared instead of appropriate gradation converted values corresponding to all the combinations of changes in gradation, and that a value obtained by converting an approximate representative value is used when a gradation level other than the representative values is inputted. On this occasion, when a gradation level other than the representative values is inputted, it is impossible to output an accurate converted value for gradation conversion. This causes a margin of error between the actual display luminance level and the target luminance level. On this occasion, by adjusting the precision of the gradation converting circuit (e.g., the number of representative values) so that the allowable margin of error is such a range of luminance levels as described above, the circuit cost can be reduced while reducing deterioration in display quality.

Further, the image display apparatus can be arranged such that the sub-frame signal generating means corrects the gradation level in the first sub-frame of a frame in which the gradation level has just varied.

Further, the image display apparatus can be arranged such that the sub-frame signal generating means corrects the gradation level in the last sub-frame of a frame in which the gradation level has just varied.

Further, the image display apparatus can be arranged such that the sub-frame signal generating means corrects the gradation level in the last sub-frame of a frame in which the gradation level has not varied yet.

Further, the image display apparatus can be arranged such that the sub-frame signal generating means corrects the gradation level both in the last sub-frame of a frame in which the gradation level has not varied yet and the first sub-frame of a frame in which the gradation level has just varied.

Further, the image display apparatus can be arranged such that the sub-frame signal generating means corrects the gradation level both in the first and last sub-frames of a frame in which the gradation level has just varied.

Further, the image display apparatus can be arranged such that the sub-frame signal generating means corrects the gradation level both in the last sub-frame of a frame in which the gradation level has not varied yet and the first and last sub-frames of a frame in which the gradation level has just varied.

Further, the image display apparatus can be arranged such that the correcting means or the sub-frame signal generating means corrects the gradation level so that, in a distribution waveform of the time-integral amount of luminance over a period equivalent to a multiple of one frame in a certain range of regions which, when a boundary portion between two regions of different input gradation levels moves on a screen, moves at the same speed as the boundary portion and contains the boundary portion, no inflection point appears in the middle of a line connecting (a) a time-integral amount obtained in a region where one of the input gradations is stable (b) a time-integral amount obtained in a region where the other one of the input gradations is stable.

Further, the image display apparatus can be arranged such that the correcting means or the sub-frame signal generating means corrects the gradation level so that, in a distribution waveform of the time-integral amount of luminance over a period equivalent to a multiple of one frame in a certain range of regions which, when a boundary portion between two regions of different input gradation levels moves on a screen, moves at the same speed as the boundary portion and contains the boundary portion, there appears no point lower than a time-integral amount obtained in a region where the lower one of the input gradations is stable.

Further, the image display apparatus can be arranged such that the correcting means or the sub-frame signal generating means corrects the gradation level so that, in a distribution waveform of the time-integral amount of luminance over a period equivalent to a multiple of one frame in a certain range of regions which, when a boundary portion between two regions of different input gradation levels moves on a screen, moves at the same speed as the boundary portion and contains the boundary portion, there appears no point higher than a time-integral amount obtained in a region where the higher one of the input gradations is stable.

Further, by combining, with the image display apparatus, a signal input section for transmitting an externally input image signal to the image display apparatus, a liquid crystal monitor for use in a personal computer or the like can be arranged.

Further, by combining a tuner section with the image display apparatus, a liquid crystal television receiver can be arranged.

INDUSTRIAL APPLICABILITY

The present invention enable a reduction in image blur and pseudo contours in a display apparatus having a hold display element (e.g., a liquid crystal element) whose response speed is relatively low, and can be applied to an image display monitor, a television receiver, a screen-integrated personal computer, a portable terminal, an on-board display apparatus, and the like.

The invention claimed is:

1. An image display apparatus for displaying an image by time-dividing one frame period of an input image signal into a plurality of sub-frame periods, comprising:

a correction section for, in order to carry out overshoot driving with respect to a pixel in which a gradation level varies by not less than a value between successive frames, correcting the gradation level in such a direction that a response speed of the pixel is increased; and an allocation section for, in accordance with an image signal whose gradation level has been corrected by the correction section, allocating a luminance to each sub-frame so that a total of time-integral values of luminance of each sub-frame within one frame period reproduces a luminance of one frame period which luminance is based on the input image signal.

2. An image display apparatus for displaying an image by time-dividing one frame period of an input image signal into a plurality of sub-frame periods, comprising:

a sub-frame signal generation section for, in order to carry out overshoot driving with respect to a pixel in which a gradation level varies between successive frames, correcting the gradation level in such a direction that a response speed of the pixel is increased, and for generating a sub-frame signal by allocating a luminance to each sub-frame so that a total of time-integral values of luminance of each sub-frame within one frame period reproduces a luminance of one frame period which luminance is based on the input image signal.

3. The image display apparatus as set forth in claim 1, wherein the correction section is configured to corrects the gradation level so that a luminance obtained at the end of each sub-frame of a frame in which the gradation level has just varied coincides with a luminance that is to be obtained at the end of each sub-frame when an uncorrected gradation level is at rest.

4. The image display apparatus as set forth in claim 1, wherein with respect to the pixel in which the gradation level varies by not less than a value between successive frames, the correction section corrects the gradation level so that a difference between (i) a luminance obtained at the end of each sub-frame of a frame in which the gradation level has just varied and (ii) a target luminance that is to be obtained at the end of each sub-frame when an uncorrected gradation level is at rest is not more than 10% of a difference between (a) a minimum luminance level of an image display panel and (b) a maximum luminance level of the image display panel.

5. The image display apparatus as set forth in claim 1, wherein with respect to the pixel in which the gradation level varies by not less than a value between successive frames, the correction section corrects the gradation level so that a difference between (i) a luminance obtained at the end of each sub-frame of a frame in which the gradation level has just varied and (ii) a target luminance that is to be obtained at the end of each sub-frame when an uncorrected gradation level is at rest is not more than 3% of a difference between (a) a minimum luminance of an image display panel and (b) a maximum luminance of the image display panel.

6. The image display apparatus as set forth in claim 1, wherein with respect to the pixel in which the gradation level varies by not less than a value between successive frames, the correction section corrects the gradation level so that when there is an increase in luminance as a result of the change, a difference between (i) a luminance obtained at the end of each sub-frame of a frame in which the gradation level has just varied and (ii) a target luminance that is to be obtained at the end of each sub-frame when an uncorrected gradation level is at rest is not more than 15% of a difference between (a) a minimum luminance level of an image display panel and (b) the target luminance.

7. The image display apparatus as set forth in claim 1, wherein with respect to the pixel in which the gradation level varies by not less than a value between successive frames, the correction section corrects the gradation level so that when there is an increase in luminance as a result of the change, a difference between (i) a luminance obtained at the end of each sub-frame of a frame in which the gradation level has been changed and (ii) a target luminance that is to be obtained at the end of each sub-frame when an uncorrected gradation level is at rest is not more than 5% of a difference between (a) a minimum luminance level of an image display panel and (b) the target luminance.

8. The image display apparatus as set forth in claim 1, wherein with respect to the pixel in which the gradation level varies by not less than a value between successive frames, the correction section corrects the gradation level so that when there is a decrease in luminance as a result of the change, a difference between (i) a luminance obtained at the end of each sub-frame of a frame in which the gradation level has just varied and (ii) a target luminance that is to be obtained at the end of each sub-frame when an uncorrected gradation level is at rest is not more than 15% of a difference between (a) a maximum luminance level of an image display panel and (b) the target luminance.

9. The image display apparatus as set forth in claim 1, wherein with respect to the pixel in which the gradation level varies by not less than a value between successive frames, the correction section corrects the gradation level so that when there is a decrease in luminance as a result of the change, a difference between (i) a luminance obtained at the end of each sub-frame of a frame in which the gradation level has been changed and (ii) a target luminance that is to be obtained at the end of each sub-frame when an uncorrected gradation level is at rest is not more than 5% of a difference between (a) a maximum luminance level of an image display panel and (b) the target luminance.

10. The image display apparatus as set forth in claim 2, wherein the sub-frame signal generation section corrects the gradation level in the first sub-frame of a frame in which the gradation level has just varied.

11. The image display apparatus as set forth in claim 2, wherein the sub-frame signal generation section corrects the gradation level in the last sub-frame of a frame in which the gradation level has just varied.

12. The image display apparatus as set forth in claim 2, wherein the sub-frame signal generation section corrects the gradation level in the last sub-frame of a frame in which the gradation level has not varied yet.

13. The image display apparatus as set forth in claim 2, wherein the sub-frame signal generation section corrects the gradation level both in the last sub-frame of a frame in which the gradation level has not varied yet and the first sub-frame of a frame in which the gradation level has just varied.

14. The image display apparatus as set forth in claim 2, wherein the sub-frame signal generation section corrects the gradation level both in the first and last sub-frames of a frame in which the gradation level has just varied.

15. The image display apparatus as set forth in claim 2, wherein the sub-frame signal generation section corrects the gradation level both in the last sub-frame of a frame in which the gradation level has not varied yet and the first and last sub-frames of a frame in which the gradation level has just varied.

16. The image display apparatus as set forth in claim 1, wherein the correction section is configured to corrects the gradation level so that, in a distribution waveform of the time-integral amount of luminance over a period equivalent to a multiple of one frame in a certain range of regions which, when a boundary portion between two regions of different input gradation levels moves on a screen, moves at the same speed as the boundary portion and contains the boundary portion, no inflection point appears in the middle of a line connecting (a) a time-integral amount obtained in a region where one of the input gradations is stable (b) a time-integral amount obtained in a region where the other one of the input gradations is stable.

17. The image display apparatus as set forth in claim 1, wherein the correction section is configured to correct the gradation level so that, in a distribution waveform of the time-integral amount of luminance over a period equivalent to a multiple of one frame in a certain range of regions which, when a boundary portion between two regions of different input gradation levels moves on a screen, moves at the same speed as the boundary portion and contains the boundary portion, there appears no point lower than a time-integral amount obtained in a region where the lower one of the input gradations is stable.

18. The image display apparatus as set forth in claim 1, wherein the correction section is configured to correct the gradation level so that, in a distribution waveform of the time-integral amount of luminance over a period equivalent to a multiple of one frame in a certain range of regions which, when a boundary portion between two regions of different input gradation levels moves on a screen, moves at the same speed as the boundary portion and contains the boundary portion, there appears no point higher than a time-integral amount obtained in a region where the higher one of the input gradations is stable.

19. An image display monitor comprising:

an image display apparatus as set forth in claim 1; and a signal input section for transmitting an externally inputted image signal to the image display apparatus.

20. A television receiver comprising:

an image display apparatus as set forth in claim 1.

21. The image display apparatus as set forth in claim 2, wherein the sub-frame signal generation section is configured to correct the gradation level so that a luminance obtained at the end of each sub-frame of a frame in which the gradation level has just varied coincides with a luminance that is to be obtained at the end of each sub-frame when an uncorrected gradation level is at rest.

22. The image display apparatus as set forth in claim 2, wherein with respect to the pixel in which the gradation level varies by not less than a value between successive frames, the sub-frame signal generation section corrects the gradation level so that a difference between (i) a luminance obtained at the end of each sub-frame of a frame in which the gradation level has just varied and (ii) a target luminance that is to be obtained at the end of each sub-frame when an uncorrected gradation level is at rest is not more than 10% of a difference between (a) a minimum luminance level of an image display panel and (b) a maximum luminance level of the image display panel.

23. The image display apparatus as set forth in claim 2, wherein with respect to the pixel in which the gradation level varies by not less than a value between successive frames, the sub-frame signal generation section corrects the gradation level so that a difference between (i) a luminance obtained at the end of each sub-frame of a frame in which the gradation level has just varied and (ii) a target luminance that is to be obtained at the end of each sub-frame when an uncorrected gradation level is at rest is not more than 3% of a difference between (a) a minimum luminance of an image display panel and (b) a maximum luminance of the image display panel.

24. The image display apparatus as set forth in claim 2, wherein with respect to the pixel in which the gradation level varies by not less than a value between successive frames, the sub-frame signal generation section corrects the gradation level so that when there is an increase in luminance as a result of the change, a difference between (i) a luminance obtained at the end of each sub-frame of a frame in which the gradation level has just varied and (ii) a target luminance that is to be obtained at the end of each sub-frame when an uncorrected gradation level is at rest is not more than 15% of a difference between (a) a minimum luminance level of an image display panel and (b) the target luminance.

25. The image display apparatus as set forth in claim 2, wherein with respect to the pixel in which the gradation level varies by not less than a value between successive frames, the sub-frame signal generation section corrects the gradation level so that when there is an increase in luminance as a result of the change, a difference between (i) a luminance obtained at the end of each sub-frame of a frame in which the gradation level has been changed and (ii) a target luminance that is to be obtained at the end of each sub-frame when an uncorrected gradation level is at rest is not more than 5% of a difference between (a) a minimum luminance level of an image display panel and (b) the target luminance.

26. The image display apparatus as set forth in claim 2, wherein with respect to the pixel in which the gradation level varies by not less than a value between successive frames, the sub-frame signal generation section corrects the gradation level so that when there is a decrease in luminance as a result of the change, a difference between (i) a luminance obtained at the end of each sub-frame of a frame in which the gradation level has just varied and (ii) a target luminance that is to be obtained at the end of each sub-frame when an uncorrected gradation level is at rest is not more than 15% of a difference between (a) a maximum luminance level of an image display panel and (b) the target luminance.

27. The image display apparatus as set forth in claim 2, wherein with respect to the pixel in which the gradation level varies by not less than a value between successive frames, the sub-frame signal generation section corrects the gradation level so that when there is a decrease in luminance as a result of the change, a difference between (i) a luminance obtained at the end of each sub-frame of a frame in which the gradation level has been changed and (ii) a target luminance that is to be obtained at the end of each sub-frame when an uncorrected gradation level is at rest is not more than 5% of a difference between (a) a maximum luminance level of an image display panel and (b) the target luminance.

28. The image display apparatus as set forth in claim 2, wherein the sub-frame signal generation section is configured to correct the gradation level so that, in a distribution waveform of the time-integral amount of luminance over a period equivalent to a multiple of one frame in a certain range of regions which, when a boundary portion between two regions of different input gradation levels moves on a screen, moves at the same speed as the boundary portion and contains the boundary portion, no inflection point appears in the middle of a line connecting (a) a time-integral amount obtained in a region where one of the input gradations is stable (b) a time-integral amount obtained in a region where the other one of the input gradations is stable.

29. The image display apparatus as set forth in claim 2, wherein the sub-frame signal generation section is configured to correct the gradation level so that, in a distribution waveform of the time-integral amount of luminance over a period equivalent to a multiple of one frame in a certain range of regions which, when a boundary portion between two regions of different input gradation levels moves on a screen, moves at the same speed as the boundary portion and contains the boundary portion, there appears no point lower than a time-integral amount obtained in a region where the lower one of the input gradations is stable.

30. The image display apparatus as set forth in claim 2, wherein the sub-frame signal generation section is configured to correct the gradation level so that, in a distribution waveform of the time-integral amount of luminance over a period equivalent to a multiple of one frame in a certain range of regions which, when a boundary portion between two regions of different input gradation levels moves on a screen, moves at the same speed as the boundary portion and contains the boundary portion, there appears no point higher than a time-integral amount obtained in a region where the higher one of the input gradations is stable.

31. An image display monitor comprising:

an image display apparatus as set forth in claim 2; and a signal input section for transmitting an externally inputted image signal to the image display apparatus.

32. A television receiver comprising:

an image display apparatus as set forth in claim 2.

* * * * *